US007527348B2

(12) United States Patent
Uetsuki et al.

(10) Patent No.: US 7,527,348 B2
(45) Date of Patent: May 5, 2009

(54) INK JET PRINTING APPARATUS

(75) Inventors: Masaya Uetsuki, Yokohama (JP); Takumi Kaneko, Tokyo (JP); Tsutomu Abe, Isehara (JP); Nobuyuki Matsumoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 389 days.

(21) Appl. No.: 11/365,624

(22) Filed: Mar. 2, 2006

(65) Prior Publication Data

US 2006/0203034 A1 Sep. 14, 2006

(30) Foreign Application Priority Data

Mar. 4, 2005 (JP) ..... 2005-061273

(51) Int. Cl.
*B41J 2/165* (2006.01)

(52) U.S. Cl. ..... 347/33; 347/23; 347/32

(58) Field of Classification Search ..... 347/29, 347/30, 32, 33, 23
See application file for complete search history.

(56) References Cited

U.S. PATENT DOCUMENTS

| | | | | |
|---|---|---|---|---|
| 5,798,775 | A | 8/1998 | Takahashi et al. | |
| 6,231,156 | B1 * | 5/2001 | Ono | 347/24 |
| 6,283,574 | B1 * | 9/2001 | Sugimoto et al. | 347/23 |
| 6,527,361 | B1 | 3/2003 | Gotoh et al. | |
| 6,557,969 | B1 | 5/2003 | Murakami et al. | |
| 6,637,855 | B2 | 10/2003 | Ide et al. | |
| 6,702,421 | B2 | 3/2004 | Inui et al. | |
| 6,984,018 | B2 | 1/2006 | Uetsuki et al. | |
| 7,118,190 | B2 * | 10/2006 | Sakamoto et al. | 347/23 |

FOREIGN PATENT DOCUMENTS

| | | |
|---|---|---|
| JP | 7-125228 | 5/1995 |
| JP | 2001-121717 | 5/2001 |
| JP | 2002-166560 | 6/2002 |

* cited by examiner

*Primary Examiner*—Shih-Wen Hsieh
(74) *Attorney, Agent, or Firm*—Fitzpatrick, Cella, Harper & Scinto

(57) ABSTRACT

In an ink jet printing apparatus carrying out printing using a plurality of ejecting portions for respectively ejecting different kinds of inks, a condition for wiping of an ejection face provided with ink ejection openings of the plurality of ejecting portions is appropriately determined and defective ejection due to a wet and dirty ejection face is effectively prevented. A timing of wiping is controlled considering kinds of inks. Specifically, the timing of wiping is determined not simply based on a number of ejections carried out by the plurality of ejecting portions to perform printing, but also a condition of an amount of mist generated in accordance with the kinds of ink.

6 Claims, 15 Drawing Sheets

| INK TYPE | | MIST AMOUNT | EJECTION RECOVERING PROPERTY |
|---|---|---|---|
| INK A | HEAD H1<br>HEATER SIZE: SMALL<br>NOZZLE: SMAL | ○ | × |
| INK B | | ○ | ○ |
| INK C | | △ | × |
| INK D | | ○ | ○ |
| INK E | | ○ | ○ |
| INK F | | △ | × |
| INK A | HEAD H2<br>HEATER SIZE: LARGE<br>NOZZLE: NORMAL | ○ | ○ |
| INK B | | △ | ○ |
| INK C | | × | ○ |
| INK D | | △ | ○ |
| INK E | | △ | ○ |
| INK F | | × | ○ |

SMALL ○ > △ > × LARGE GOOD ○ > △ > × POOR

FIG.11

| INK TYPE | No. | A | B | C | D | E | F | TOTAL | WIPING PROPERTY |
|---|---|---|---|---|---|---|---|---|---|
| PRINTING DUTY | 1 | 20% | 20% | 20% | 20% | 20% | 50% | 150% | × |
| | 2 | 50% | 20% | 20% | 20% | 20% | 20% | 150% | △ |
| | 3 | 10% | 10% | 10% | 10% | 10% | 100% | 150% | × |
| | 4 | 30% | 30% | 30% | 30% | 30% | 0% | 150% | ○ |

WIPING PROPERTY

○ : EJECTION FAILURE DUE TO WETTING

△ : OCCURRENCE OF EJECTION FAILURE IN CHECK PATTERN WITH HIGH DUTY DUE TO WETTING

× : OCCURRENCE OF EJECTION FAILURE ALSO IN CHECK PATTERN WITH LOW DUTY DUE TO WETTING

FIG.12

| WIPING CONDITION | PRINTING RESULT | HEAD DURABILITY |
|---|---|---|
| i | ○ | ○ |
| ii | × | ○ |
| iii | ○ | × |
| iv | ○ | × |

PRINTING RESULT

○ : NO EJECTION FAILURE DUE TO WETTING

× : EJECTION FAILURE DUE TO WETTING

HEAD DURABILITY

○ : POSSIBLE TO PRINT UNTIL HEAD LIFE

× : OCCURRENCE OF WIPING FAILURE BEFORE HEAD LIFE

FIG.13

INK JET PRINTING APPARATUS

BACKGROUND OF THE INVENTION

1. Field of the Invention

The present invention relates to an ink jet printing apparatus which performs printing by ejecting ink from a print head to a print medium.

2. Description of the Related Art

It is known that the ink adheres to a print head surface (hereinafter referred to as an ejection face) where ejection openings (nozzles) are formed in an ink jet printing apparatus in general. This is because when the ink is ejected from a nozzle, a large amount of small ink droplets (hereinafter referred to as mist) are ejected separately from the primary ink droplets (main droplets) for printing purposes. The mist generated in a large amount drifts in a space between the print head and a print medium and comes back and adheres to the ejection face of the print head due to its small mass. Moreover, there is also mist which is formed by a part of main droplets once landed on the print medium surface is bounced back and re-adhering the ejection face.

Such mist let the ejection face wet and especially when adhered to a vicinity of the ejection opening, this adhered ink causes a defective ejection such as a reduction in ink ejecting directivity (this phenomenon is called 'deflection' since the ejecting direction is deflected by pulling ejected main droplets. This may then cause a reduction in printing image qualities. In addition, it may also cause ejection failures in an extreme case.

In order to resolve such a state where the ejection face gets wet and may cause defective ejection or ejection failure), a wiping member to wipe the ejection face called a wiper is generally installed in the ink jet printing apparatus. An action to wipe away (wiping) the ink mist adhered to the ejection face is carried out at an appropriate timing. As an example for such an action, Japanese Patent Application Laid-open No. 07-125228(1995) discloses a method to determine the timing of wiping by combining the use of a timer and counting (dot count) of ink ejection number by the print head. In addition, Japanese Patent Application Laid-open No. 2001-121717 discloses a method for determining the timing of wiping by combining usual dot count and printing duty.

Moreover, there is a case where the mist adhered to the ejection face increases its viscosity due to the evaporation of ink solvents, by a high temperature of the print head or an inability to carry out wiping during long time-requiring printing. For these reasons, in a case where deterioration in wiping ability is a concern, there are those adopting responses like carrying out wiping after wetting a wiper in advance with ink or stock/prepared solutions of other solvents (for example, Japanese Patent Application Laid-open No. 2002-166560).

However, there is a case where favorable wiping ability (ejection face cleaning ability) cannot be displayed due to the low efficiency in wiping even when the wiper is provided as described above and the timing of the wiping is determined. For example, a plurality of ejecting portions capable of ejecting ink with different color tones (including color and concentration) in the main scanning direction may be juxtaposed in an ink jet print head adopted in the ink jet printing apparatus of a serial scan type. For such a configuration, a wiper carrying out the wiping operation all at once is provided in a plurality of ejecting portions in many cases.

A case where there is an extreme differences in properties of ink used among the ejecting portions is considered in such a configuration. For example, when there are 6 ejecting portions a to f present corresponding to 6 colours of ink A to F and especially when the ink C ejected from the ejecting portion c generates mist readily, much mist is adhered to the ejecting face of the ejecting portion c than to those of others even when printing with similar duty is carried out in each ejecting portion.

Here, a difference in the amount of ink mist generated is dominated by various factors. As factors due to characteristics of ink alone, examples include viscosity, surface tension, and contact angle with a material forming the nozzle. Moreover, the amount of mist generated is also further changed in a variety of ways by the combination of power applied to make the print head or the ejecting portion carry out the ejection action and physical properties of ink. Furthermore, the differences in the amount of ink mist generated and the amount of ink adhered between each ejecting portion occur when considering various factors such as ejection speed, ink landing stability onto the print medium, recovery ability from fixed adhesion of the ink, and the prevention of ink solvent evaporation from the nozzle at the time of printing, in order to take advantage of characteristics of each ink.

Therefore, to carry out the wiping operation in the identical conditions against a plurality of ejecting portions is not necessarily favourable since the number of wiping will be too small for one ejecting portion (for example, above described ejecting portion A) and there is a concern that the cleaning of the ejecting portion will be insufficient. However, these differences in the amount of ink mist generated or the adhered amount have not been hitherto considered. For example, even when the dot count was carried out to determine the timing of the wiping operation by considering the printing duty as described in Japanese Patent Application Laid-open No. 2001-121717, the occurrence of variations in the amount of mist in each ejecting portion could not be dealt with.

Moreover, an increase in viscosity due to evaporation of ink solvents has not hitherto considered and it has been thought that all inks exhibit the identical characteristics including evaporation and phenomena associated with it. Consequently, although differences exist in the ease of wiping due to the difference in evaporation characteristic of each ink when the wiping operation is actually carried out, the wiping operation has been carried out against a plurality of ejecting portions all at once and uniformly. Accordingly, after such the wiping, an ejection face of some ejecting portion becomes a good state, while an ejection face of some ejecting portion is still unsatisfactory state.

SUMMARY OF THE INVENTION

The present invention is accomplished to solve problems described so far.

In the present invention, there is provided an ink jet printing apparatus carrying out printing using a plurality of ejecting portions for ejecting different kinds of inks, respectively, comprising:

a wiping member for wiping a surface provided with ejection openings of the plurality of ejecting portions for ejecting the respective inks, and wiping control means for controlling a timing for causing the wiping member to carry out the wiping based on conditions of inks which are used in the plurality of ejecting portions.

According to the present invention, optimal wiping can be carried out while taking conditions (e.g. the difference in the amount of mist generated depending on the ink types and ink viscosity when evaporating) of ink used by a plurality of ejecting portions into consideration. Improper ejection or ejection failure due to the wetting and smears of the ejection face can be prevented by this effectively.

The above and other objects, effects, features and advantages of the present invention will become more apparent from the following description of embodiments thereof taken in conjunction with the accompanying drawings.

BRIEF DESCRIPTION OF THE DRAWINGS

FIG. 11 shows the amount of mist in a case where plural kinds of inks are ejected using two print heads with heaters and nozzles, each of which differ in size in the ejecting portions, and a result determining ejection recovery in a case where qualities of ejection state are determined following normal recovery operation after leaving the print head under predetermined conditions;

FIG. 12 is an explanatory diagram for explaining wiping after printing was carried out with plural kinds of inks and changing printing duties while using conventional wiping conditions;

FIG. 13 is an explanatory diagram of print results as well as print head durability evaluation results in a case where wiping conditions are set based on the present embodiment and in a case of a comparative example where various wiping conditions are set;

DETAILED DESCRIPTION OF PREFERRED EMBODIMENTS

The present invention will be described below in detail by referring to attached figures.

(1) Mechanical Configuration of Ink Jet Printing Apparatus

(1-1) Apparatus Outline

Figure 1:
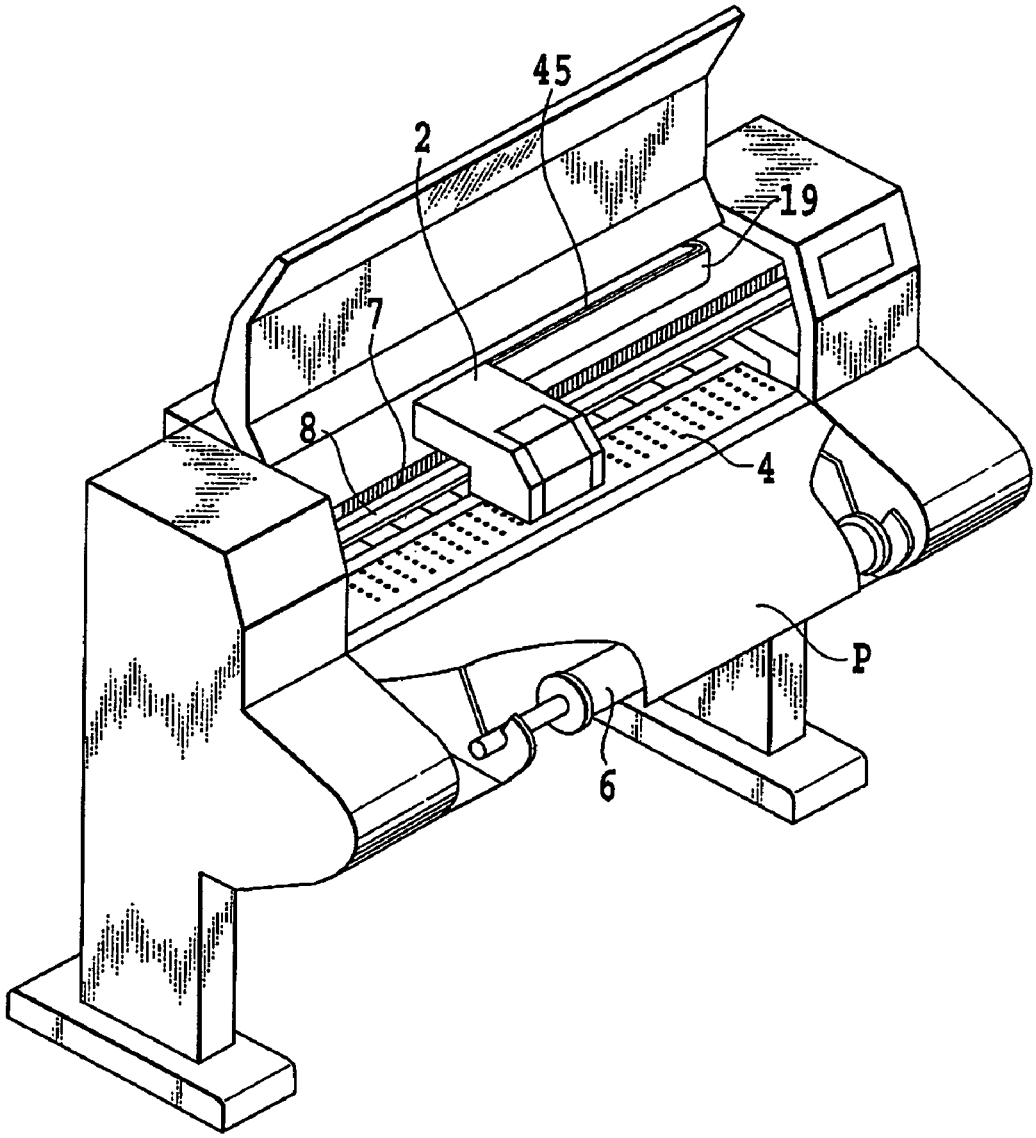
FIG. 1 is a schematic perspective view showing an appearance of an ink jet printing apparatus (printer) according to an embodiment of the present invention.

FIG. 1 is a schematic perspective view showing an appearance of an ink jet printing apparatus (hereinafter also referred to as a printer) according to an embodiment of the present invention. This is the printer of so called serial scan type and forms images by scanning (main scan) the print head in a direction perpendicular to a conveying direction of a print medium P.

A configuration of this printer and an outline of an action at the time of printing will be explained using FIG. 1. Firstly, the print medium P is conveyed by a paper supply roller 6 driven via a gear by a paper supply motor which is not illustrated. On the other hand, a carriage unit 2 is made to scan along a guide shaft 8 extending in a direction perpendicular to the conveying direction by a carriage motor which is not illustrated. In this scanning process, ejection action is carried out from ink ejection openings (nozzles) of a print head (described later) detachably mounted on the carriage unit 2 with a timing based on position signals obtained by an encoder 7, and fixed bandwidth is printed corresponding to the range of nozzle arrangement. It is configured to carry out the conveying of the print medium thereafter and further printing of the next bandwidth is carried out. There is a case where the conveying of the print medium in an amount equal to the bandwidth between each scan is carried out in such a printer. Moreover, where necessary, there is also a case where conveying of the amount of bandwidth is not carried out for each one scan, and conveying is carried out after the scan is performed a plurality of times. Alternatively, there is also a case where a printing method is adopted in which paper feeding of around 1/n of bandwidth is performed after printing data thinned out by a predetermined mask for each one scan and then carrying out a rescan. This printing method is a method of completing images by plural times of scanning and plural times of conveying with different nozzles participating in the printing of one image region and is called a multipass printing method.

A flexible interconnection substrate 19 is attached to the print head for supplying signal pulses for driving the nozzles or signals for head temperature adjustment. The other end of the flexible substrate is connected to a control circuit (described later) provided with a control circuit to execute control of the present printer. Ink is supplied via an ink supply tube 45 from a respective one of ink tanks which reserve 6 colours, respectively, and supplying a respective one of the colours individually independently to the print head mounted on the carriage unit 2 as described later in FIGS. 2 and 4. Moreover, at a position in a range where the carriage unit 2 is movable, for example in a home position of the print head, recovery unit (FIG. 5) for carrying out recovery process of the print head is provided.

Incidentally, a carriage belt can be used for transmitting the driving force from a carriage motor to the carriage unit. However, it is possible to use other driving methods. For example, those with a lead screw driven rotatively by the carriage motor and extending in a main scanning direction, an engaging portion engaging with a lead screw groove, and so on instead of a carriage belt can also be used.

Fed print medium P is conveyed while held between a paper supply roller 6 and a pinch roller which is not illustrated and introduced to a printing position (main scanning area of the print head) on a platen 4. Since the ejection face of the print head is capped in a dormant state, a cap is released and the print head or the carriage unit 2 is set in a state capable of being scanned prior to the printing. Subsequently, when the amount of data corresponding to one scanning operation is accumulated in a buffer, the carriage unit 2 is made to scan by a carriage motor 3 and printing is carried out as described above.

(1-2) Print Head Configuration

Figure 2:
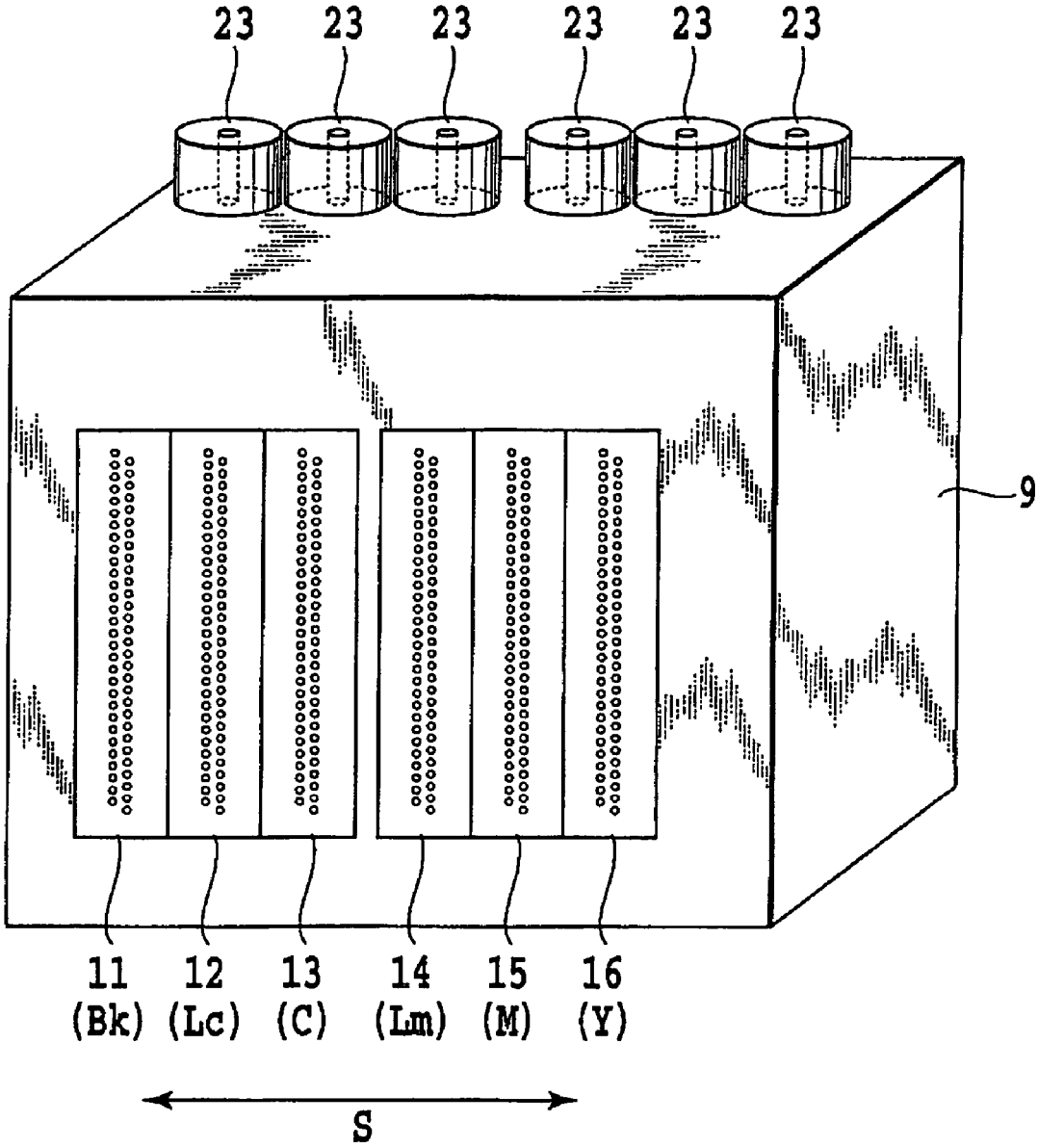
FIG. 2 is a schematic perspective view of a print head mounted on a carriage unit of the printer in FIG. 1 taken viewed from an ink ejection side.

FIG. 2 is a schematic perspective view of a print head mounted in the carriage unit 2 of the above described printer taken viewed from an ink ejection side. A plurality of ejecting portions capable of ejecting inks with different colour tones (including colour and concentration) are juxtaposed on the print head 9 in the main scanning direction. A plurality of ejecting portions 11 to 16 capable of ejecting black (Bk), light cyan (Lc), cyan (C), light magenta (Lm), magenta (M), and yellow (Y) inks are juxtaposed in the example shown by the figure. Ink is supplied to each ejecting portion from an ink introducing portion 23 via an ink flow channel inside the print head. Ink is introduced to the ink introducing portion 23 by an ink tank described later via a tube.

Figure 3:
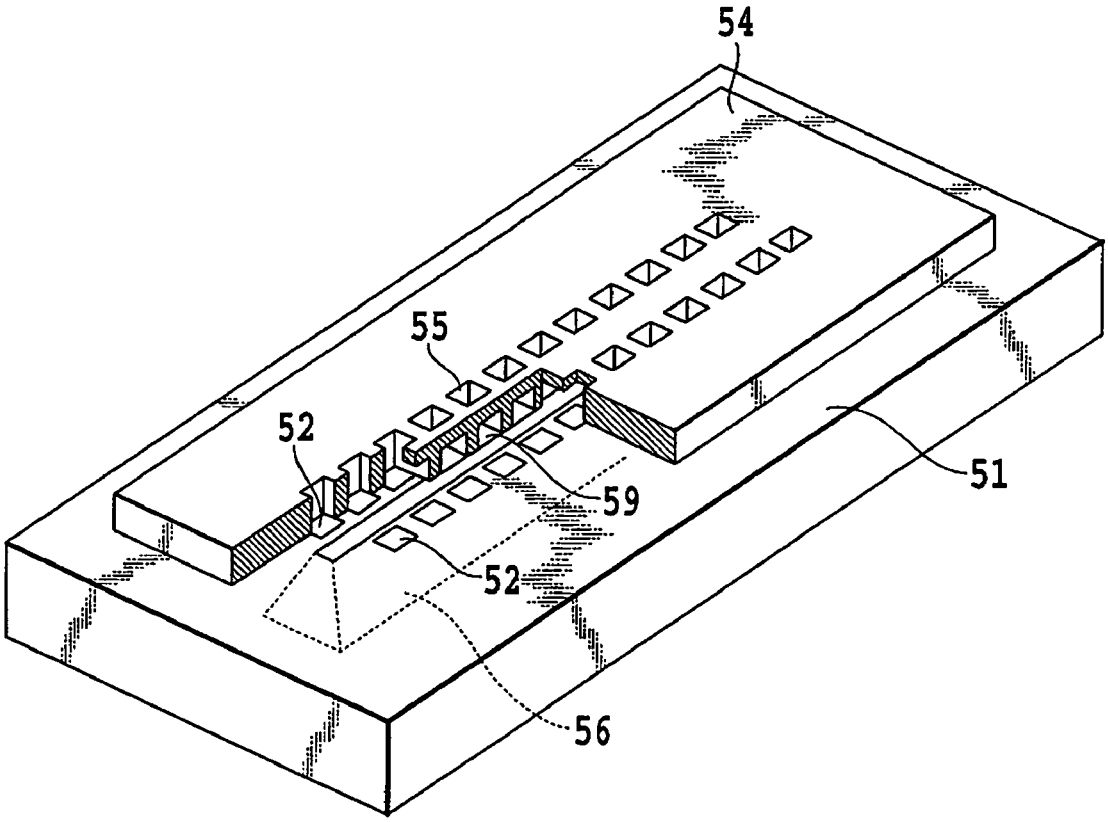
FIG. 3 is a schematic perspective view of an ejecting portion provided in the print head in FIG. 2.

FIG. 3 is a schematic perspective view of each ejecting portion. Each ejecting portion is that of a system using thermal energy for generating film boiling in ink in response to electrification as an energy used for ejecting ink and having a substrate 51 on which two heat generating portion arrays are juxtaposed. A plurality of heat generating portions 52 are arranged in the heat generating portion array with a predetermined pitch. An ink supplying port 56 communicating with the above-described ink flow channel is provided between the heat generating portion arrays on the substrate 51. A member (orifice plate) 54, on which nozzles 55 corresponding to the heat generating portions 52 and ink paths 59 for supplying ink from the ink supply port 56 to the nozzles 55 are formed, is joined to the substrate 51 thereby configuring an ejecting portion.

Desired printing resolution is realized by placing two arrays of the heat generating portions 52 in a staggered manner by shift of a half pitch. Here, it is possible to set the same printing density and the nozzle number for the ejecting portions 11 to 16, respectively, or to set different printing densities and nozzle numbers. In the present embodiment, 640 nozzles are aligned with a density of approximately 245 nozzles per each 1 cm in the ejecting portion 11 for Bk and 1280 nozzles are aligned with densities of approximately 490 nozzles per 1 cm for each color in the ejecting portions 11 to 15 for other color inks.

Incidentally, although ejecting portion adopting a method, which the heat generating portion 52 ejects ink in a vertical direction to the substrate 51 is used in the present example, an ejecting portion with a configuration of ejecting ink in a parallel direction can also be used.

(1-3) Ink Supply System

Figure 4:
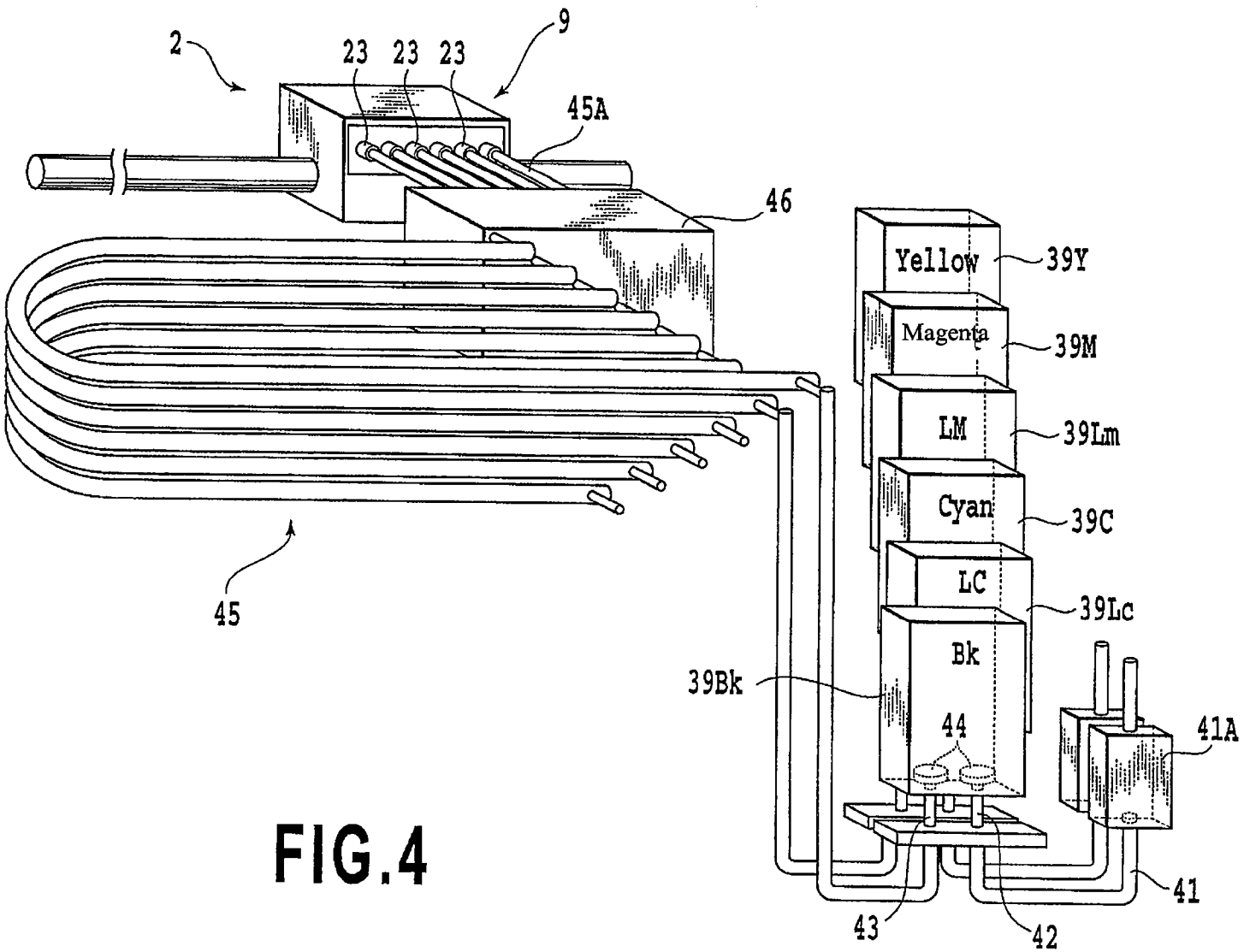
FIG. 4 is a schematic perspective view showing an example of a configuration of ink supply system to the print head in FIG. 2.

FIG. 4 shows an example of a configuration of ink supply system to the above described printing head or to the ejecting portion. There are mainly two methods for supplying ink to the printing head or to the ejecting portion. One is to supply ink to the printing head directly by mounting an ink tank containing ink on a carriage. The other is to supply ink to by connecting between an ink tank disposed on a fixed part of the printing apparatus and the printing head mounted in the carriage and this method is adopted as one example in the present embodiment.

Different inks of black (Bk), light cyan (Lc), cyan (C), light magenta (Lm), magenta (M) and yellow (Y) are housed in the ink tanks 39Bk, 39Lc, 39C, 39Lm, 39M, and 39Y, respectively. The ink supplying tube 45 connected to each of ink tanks has flexibility capable of following the movement (scanning) of the carriage unit 2 or the print head 9. Denoted 46 is a joint mounted on the carriage unit 2 with the print head. The joint 46 is connected with the other end of each of supply tubes 45, and has an ink introducing tube 45A binding to an ink introducing portion 23 of the print head 9.

Each ink tank is formed of resins such as PP and PE and molded by injection blow and so on and assembled using techniques such as ultrasonic welding, hot welding, adhesion, and fitting. In FIG. 4 a type whose tank exterior package functions as an ink chamber is shown as an example. While a joint rubber 44 is arranged in the bottom portion thereof, a hollow needle 43 provided in the end portion of the supply tube 45 penetrates the joint rubber 44 and receive ink supply by intruding into the ink chamber. Moreover, atmosphere communicating tube 41 is connected to each ink tank via a hollow needle 42 and the internal pressure is kept almost constant by the supply of air with an amount equal to that of the consumed ink to inside of the ink chamber through here. Negative pressure applied to the print head occurs due to the differences in water head between a nozzle 52 and a meniscus formed in an opening of the hollow needle 42. In the present embodiment, negative pressure is set to −90 mmAq. Moreover, a buffer chamber 41A is interposed in the atmosphere communicating tube 41. When there is a change in the pressure in the ink chamber, the buffer chamber 41A performs a function of avoiding influencing the supply tube 45 and the print head 9 due to the change in pressure, by absorbing this. For example, this performs a function like a temporal retention of ink overflowing from inside the tank by expansion of air inside the tank.

It should be noted the ink tank configuration is not limited to the one described above. For example, the one with an ink bag inside filled with ink or the one with a porous material filled therein for retaining ink by means of impregnation and at the same time generating negative pressure to maintain ink meniscus formed in the ink ejection opening of the print head can also be adopted. Moreover, as such a form of tank with a negative pressure generating mechanism, the one provided with a flexible bag containing ink and biased in the direction to expand the inner volume of the bag by a spring mechanism and so on provided inside or outside the bag.

(1-4) Recovery Unit

The carriage unit stops at a home position before initiation of printing or during printing where necessary. Recovery unit including a cap and a wiper blade is placed in the vicinity of the home position.

Figure 5:
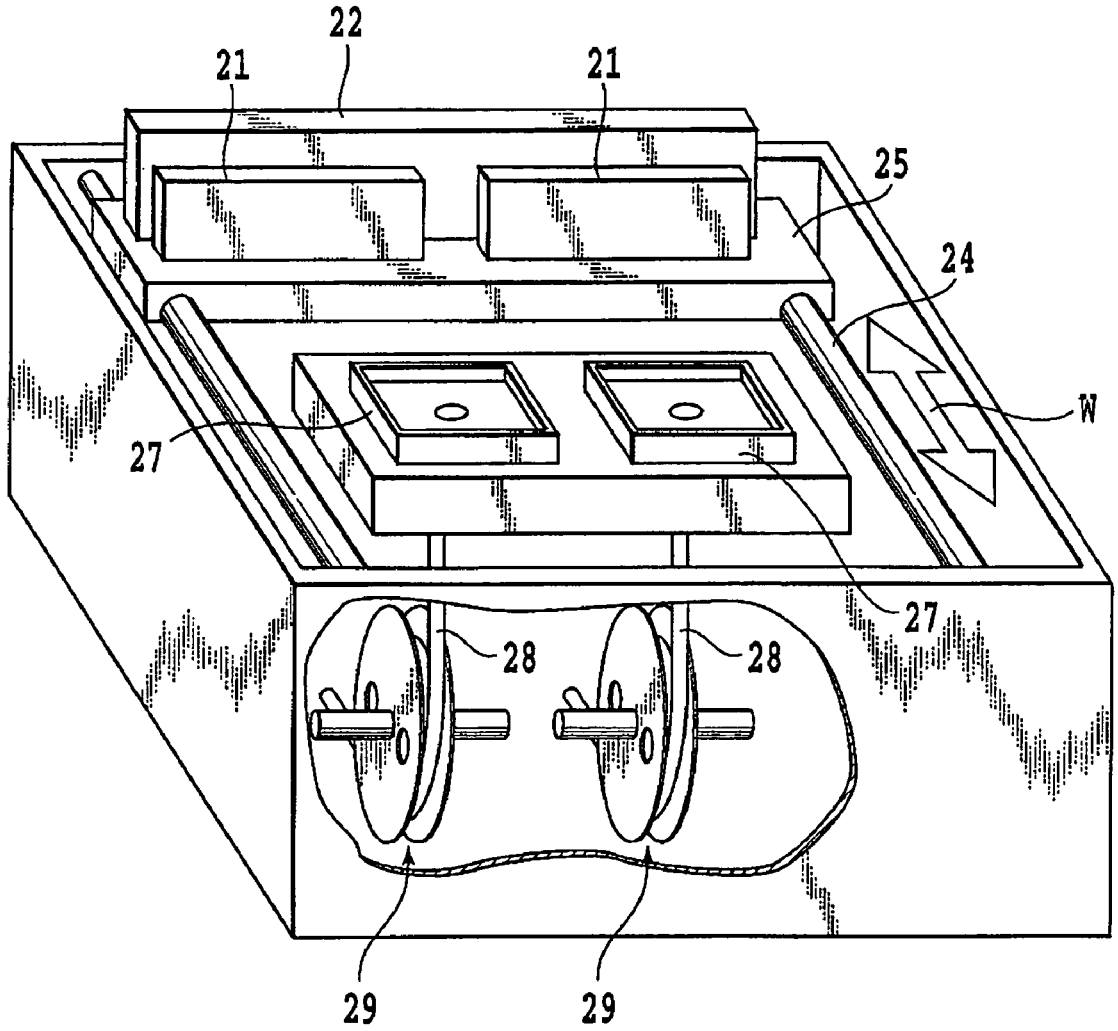
FIG. 5 is a schematic perspective view showing an example of a configuration of a recovery system unit for the print head in FIG. 2.

FIG. 5 is a schematic perspective view showing an example of a configuration of a recovery unit. A cap 27 is supported in a way being capable of ascent/descent by a not illustrated lift mechanism. At the ascending position, each ejection face of three ejecting portions is subjected to capping and its protection during the non printing operation and so on is carried out or it is possible to carry out suction recovery. At the time of printing operation, it is set at the descending position to avoid interference from the print head 9. Additionally, it is possible to receive preliminary ejection by opposing the ejection face.

Wiper blades 21 and 22 formed of elastic members like rubber and so on are fixed to a wiper holder 25. The wiper holder 25 is movable forwardly and backwardly in the direction (nozzle arrangement direction in the ejecting portion) shown with an arrow W in the figure along a guide 24. Wiping is then possible by the movement of the wiper holder 25 in the direction of the arrow W when the print head 9 reaches the home position. When the wiping is completed, after evacuating the carriage to the outside of a wiping area, the wiper is returned to a position where it does not interfere the ejection face and so on. In the present example, two wiper blades 21, each of which perform wiping of ejection faces of three ejecting portions as a unit, and the wiper blade 22, which performs wiping of the entire surface of the pint head 9 including ejection faces of ejecting portions 11 to 16 are provided.

A suction pump 29 generates negative pressure in a state where the cap 27 is connected to the ejection face and forming an enclosed space inside thereof. Hereby, it is possible to fill ink from an ink tank to the print head or the inside of the ejecting portion and to aspirate and remove dusts, affixes, air bubbles, and so on present in the ejection opening or ink path inside thereof. In the example shown in the figure, the suction pump 29 in the form of a tube pump is used. This can be the one having a member forming a curved surface for holding a tube 28 (at least a part of it) with flexibility, a roller capable of pressing force on the flexible tube towards this surface and a roller supporting portion which supports this roller and is capable of rotating. In other words, by rotating the roller supporting portion in the predetermined direction, the roller rolls on the curved surface forming member while crushing the flexible tube. Accompanying this, negative pressure generates in an enclosed space formed by a cap 7 sucking ink from the ejection opening. The sucked ink is drawn from a cap 27 to a tube or a suction pump, and drawn ink is further transferred towards an appropriate member (waste ink absorber).

Moreover, the suction pump 29 can operate not only for such suction recovery but also for discharging ink received by the cap 27 by a preliminary ejection operation carried out in a state where the cap 27 is opposing the ejection face. In other words, by operating the suction pump 29 when ink preliminary ejected and retained in the cap 27 reaches the predetermined amount, it is possible to transfer ink retained inside the cap 27 to the waste ink absorber via a tube 28.

(2) Ink

Ink usable with the printer of above described configuration will be described next. As ink(s), there are inks containing dye components or pigment components in colouring materials (hereinafter referred to as dye ink and pigment ink, respectively) and inks containing both components, and so on.

As dyes to use, various dyes conventionally known in the technical field can be used. Examples include azo dyes and phthalocyanine dyes as direct dyes, azo dyes and anthraquinone dyes as acidic dyes, and so on.

Moreover, also in the case of using pigments, all the organic and inorganic pigments conventionally publicly-known can be used. Examples include phthalocyanine pigments and azo pigments such as azo lake, insoluble azo pigments, condensed azo pigments, and chelate azo pigments, perylene and perylene pigments, polycyclic pigments such as anthraquinone pigments, quinacridone pigments, dioxazine pigments, thioindigo pigments, isoindolinone pigments, quinophthalone pigments, dye lakes such as basic dye lakes and acidic dye lakes, organic pigments such as nitro pigments, nitroso pigments, aniline black, daylight fluorescent pigments, and so on, and inorganic pigments such as titanium oxide, iron oxides, and carbon blacks and so on. Moreover, any pigments can be used even when they are not described in colour index as long as they are water dispersible.

Water soluble resins (dispersion resins) contained in order to disperse pigments to ink, are soluble in aqueous solutions of amines or bases and also their weight average molecular weights preferably range from 3000 to 30000. Furthermore, those with weight average molecular weights ranging from 5000 to 15000 are more preferable. For example, styrene-acrylic acid copolymers, styrene/acrylic acid/acrylic acid alkyl ester copolymers, styrene-maleic acid copolymers, styrene/maleic acid/acrylic acid alkyl ester copolymers, styrene/methacrylic acid copolymers, styrene/methacrylic acid/acrylic acid alkyl ester copolymers, styrene/maleic acid half ester copolymers, vinyl naphthalene/acrylic acid copolymers, vinyl naphthalene/maleic acid copolymers, styrene/maleic anhydride/maleic acid half ester copolymers or salts thereof can be used as the water soluble resins.

When ink using both pigment components and dye components is adopted, component ratio of pigment: dye (weight ratio) is desirably in the range of 8:2 to 2:8. More preferable range is from 7:3 to 3:7 (pigment: dye).

Furthermore, as for ink, the adjustment of the entire ink to neutral or alkaline is desirable since it improves the solubility of the aforementioned water-soluble resin and make the ink excellent in still further long-term preserving stability. Since there is a case where pH of ink can cause corrosion of various members used in the ink jet printing apparatus, the desirable range of pH is from 7 to 10.

Examples of pH adjuster include various organic amines such as diethanolamine and triethanolamine, inorganic alkaline chemicals like hydroxides of alkaline metals such as sodium hydroxide, lithium hydroxide, and potassium hydroxide, organic acids, and mineral acids.

Water-based media preferable for ink are mixed solvents of water and water-soluble organic solvents, and ion-exchanged water (deionised water) is preferably used rather than common water containing various ions. Ink in the present invention is water type ink and the water content is preferably 50% or more of the total ink weight.

Examples of water-soluble organic solvents used by mixing with water include alkyl alcohols with a number of carbon atoms of 1 to 4 such as methyl alcohol, ethyl alcohol, n-propyl alcohol, isopropyl alcohol, n-butyl alcohol, sec-butyl alcohol, tert-butyl alcohol, isobutyl alcohol; amides such as dimethyl formamide, dimethyl acetamide; keto alcohols such as acetone and diacetone alcohols; ethers such as tetrahydrofuran and dioxane; polyalkylene glycols such as polyethylene glycol and polypropylene glycol; alkylene glycols with alkylene groups containing 2 to 6 carbon atoms such as ethylene glycol, propylene glycol, butylene glycol, triethylene glycol, 1,2,6-hexane triol, thiodiglycol, hexylene glycol, and diethylene glycol; lower alkyl ethers of polyalcohols such as glycerin/ethylene monomethyl (or monoethyl) glycol ether, and diethylene methyl (or ethyl) glycol ether, triethylene monomethyl (or monoethyl) glycol ether, and N-methyl-2-pyrrolidone, and 1,3-dimethyl-2-imidazolidinone.

As a water-soluble organic solvents, most of those hitherto known and used as/for ink can be used. Specifically, alkyl alcohols with 1 to 5 carbon atoms such as methyl alcohol, ethyl alcohol, n-propyl alcohol, isopropyl alcohol, n-butyl alcohol, sec-butyl alcohol, tert-butyl alcohol, isobutyl alcohol, and n-penthanol; amides such as dimethylformamide and dimethylacetamide; ketones or keto alcohols such as acetone and diacetone alcohol; ethers such as tetrahydrofuran and dioxane; oxyethylene or oxypropylene adduct polymers such as diethylene glycol, triethylene glycol, tetraethylene glycol, dipropylene glycol, tripropylene glycol, polyethylene glycol, and polypropylene glycol; alkylene glycols with alkylene groups containing 2 to 6 carbon atoms such as ethylene glycol, propylene glycol, trimethylene glycol, butylene glycol, 1,2,6-hexane triol, and hexylene glycol; thiodiglycol; lower alkyl ether of polyalchols such as ethylene monomethyl (or monoethyl) glycol ether, dithylene monomethyl (or monoethyl) glycol ether and triethylene monomethyl (or monoethyl) glycol ether; lower dialkyl ethers of polyalcohols such as triethylene dimethyl (or diethyl) glycol ether and tetraethylene dimethyl (or diethyl) glycol ether; sulfolane, N-methyl-2-pyrrolidone, and 1,3-dimethyl-2-imidazolidinone. Contents of such water-soluble organic solvents as described above are generally in the range of 1 to 49% in weight % relative to the total weight of ink and preferably in the range of 2 to 30%. Moreover, water-soluble organic solvents as described above can be used alone or as a mixture. However, the most preferable solution medium composition when having both media is the one containing at least one type of water-soluble organic solvents with high boiling points like polyalcohols such as diethylene glycol, triethylene glycol, and glycerin.

Moreover, apart from the components described above, surfactants, anti-foaming agent, antiseptics and so on can be further added to ink in order to make ink with desired physical property values where necessary. Commercially available water-soluble dyes and so on can also be added.

Examples of each color ink used for the above described printer will be described below.

(2-1) Yellow Ink

Dispersion Preparation 10 parts of pigment [C. I. pigment yellow 74 (product name: Hansa Brilliant Yellow 5GX (manufactured by Clariant International Ltd.))], 30 parts of anionic polymer P-1 [styrene/butyl acrylate/acrylic acid copolymer (copolymerisation ratio (weight ratio)=30/40/30), acid value 202, weight average molecular weight 6500, a solution of 10% solid content, neutralizer: potassium hydroxide], and 60 parts of pure water are mixed and materials described below were fed into a batch upright sand mill (manufactured by Aimex Co., Ltd.), filled with 150 parts of zirconia beads with a diameter of 0.3 mm, water cooled, and dispersing process was performed for 12 hours. Furthermore, this dispersion was centrifuged and the coarse particles were removed. A pigment dispersion with a solid content of approximately 12.5% and a weight average particle diameter of 120 nm as a final preparation was then obtained. Using the obtained pigment dispersion, ink was prepared as described below.

Ink Preparation

Yellow ink was prepared by mixing components described below and after sufficient stirring and dissolution/dispersion, the resultant was filtered under pressure using a microfilter (manufactured by Fuji Photo Film Co., Ltd.) with a pore size of 1.0 μm.

| | |
|---|---|
| Obtained pigment dispersion as described above | 40 parts |
| glycerin | 9 parts |
| ethylene glycol | 6 parts |
| acetylene glycol ethylene oxide adduct (product name: Acetylenol EH (manufactured by Kawaken Fine Chemicals Co., Ltd.)) | 1 parts |
| 1,2-hexane diol | 3 parts |
| polyethylene glycol (molecular weight 1000) | 4 parts |
| water | 37 parts |

(2-2) Magenta Ink

Dispersion Preparation

Firstly, an AB type block polymer with an acid value of 300 and a number average molecular weight of 2500 was prepared by a normal method using benzyl acrylate and methacrylic acid as raw materials. The polymer was then neutralized with a potassium hydroxide solution and by diluting the resultant with ion-exchanged water, a homogeneous polymer solution of 50 weight % was prepared.

100 g of the above described polymer solution, 100 g of C. I. pigment red 122, and 300 g of ion-exchanged water were mixed and mechanically stirred for 0.5 hours.

This mixture is then processed by passing through an interaction chamber 5 times under a fluid pressure of approximately 70 MPa using a microfluidizer.

Furthermore, the dispersion obtained as described above is subjected to centrifugation process (12,000 rpm, 20 minutes) and magenta dispersion is prepared by removing undispersed materials including coarse particles. Obtained magenta dispersion had a pigment concentration of 10 weight % and a dispersant concentration of 5 weight %.

Ink Preparation

Using the above described magenta dispersion, components described below were added to achieve predetermined concentrations and after sufficiently mixing and stirring these components, the resultant was filtered under pressure using a microfilter (manufactured by Fuji Photo Film Co., Ltd.) with a pore size of 2.5 μm to prepare a pigment ink with a pigment concentration of 4 weight % and a dispersant concentration of 2 weight %.

| | |
|---|---|
| above described magenta dispersion | 40 parts |
| glycerin | 10 parts |
| diethylene glycol | 10 parts |
| acetylene glycol EO adduct (manufactured by Kawaken Fine Chemicals Co., Ltd.) | 0.5 parts |
| ion-exchanged water | 39.5 parts |

(2-3) Light Magenta Ink

Dispersion Preparation 100 g of the polymer solution used for preparing the magenta ink, 100 g of C. I. pigment red 122, and 300 g of ion-exchanged water were mixed and mechanically stirred for 0.5 hours.

This mixture is then processed by passing through the interaction chamber 5 times under a fluid pressure of approximately 70 MPa using a microfluidizer.

Furthermore, the dispersion obtained as described above is subjected to centrifugation process (12,000 rpm, 20 minutes) and magenta dispersion is prepared by removing undispersed materials including coarse particles. Obtained magenta dispersion had a pigment concentration of 10 weight % and a dispersant concentration of 5 weight %.

Ink Preparation

Using the above described magenta dispersion, components described below were added to achieve predetermined concentrations and after sufficiently mixing and stirring these components, the resultant was filtered under pressure using a microfilter (manufactured by Fuji Photo Film Co., Ltd.) with a pore size of 2.5 μm to prepare a pigment ink with a pigment concentration of 4 weight % and a dispersant concentration of 2 weight %.

| | |
|---|---|
| above described magenta dispersion | 8 parts |
| glycerin | 10 parts |
| diethylene glycol | 10 parts |
| acetylene glycol EO adduct (manufactured by Kawaken Fine Chemicals Co., Ltd.) | 0.5 parts |
| ion-exchanged water | 71.5 parts |

(2-4) Cyan Ink

Dispersion Preparation

Firstly, an AB type block polymer with an acid value of 250 and a number average molecular weight of 3000 was prepared by a normal method using benzyl acrylate and methacrylic acid as raw materials. The polymer was then neutralized with a potassium hydroxide solution and by diluting the resultant with ion-exchanged water, a homogeneous polymer solution of 50 weight % was prepared.

180 g of the above described polymer solution, 100 g of C. I. pigment blue 15:3, and 220 g of ion-exchanged water were mixed and mechanically stirred for 0.5 hours.

This mixture is then processed by passing through an interaction chamber 5 times under a fluid pressure of approximately 70 MPa using a microfluidizer.

Furthermore, the dispersion obtained as described above is subjected to centrifugation process (12,000 rpm, 20 minutes) and cyan dispersion is prepared by removing undispersed materials including coarse particles. Obtained cyan dispersion had a pigment concentration of 10 weight % and a dispersant concentration of 10 weight %.

Ink Preparation

Using the above described cyan dispersion, components described below were added to achieve predetermined concentrations and after sufficiently mixing and stirring these components, the resultant was filtered under pressure using a microfilter (manufactured by Fuji Photo Film Co., Ltd.) with a pore size of 2.5 μm to prepare a pigment ink with a pigment concentration of 2 weight % and a dispersant concentration of 2 weight %.

| | |
|---|---|
| above described cyan dispersion | 20 parts |
| glycerin | 10 parts |
| diethylene glycol | 10 parts |
| acetylene glycol EO adduct (manufactured by Kawaken Fine Chemicals Co., Ltd.) | 0.5 parts |
| ion-exchanged water | 53.5 parts |

(2-5) Light Cyan Ink

Dispersion Preparation 180 g of the polymer solution used for preparing the cyan ink, 100 g of C. I. pigment blue 15:3, and 220 g of ion-exchanged water were mixed and mechanically stirred for 0.5 hours.

This mixture is then processed by passing through the interaction chamber 5 times under a fluid pressure of approximately 70 MPa using a microfluidizer.

Furthermore, the dispersion obtained as described above is subjected to centrifugation process (12,000 rpm, 20 minutes) and cyan dispersion is prepared by removing undispersed materials including coarse particles. Obtained cyan dispersion had a pigment concentration of 10 weight % and a dispersant concentration of 10 weight %.

Ink Preparation

Using the above described cyan dispersion, components described below were added to achieve predetermined concentrations and after sufficiently mixing and stirring these components, the resultant was filtered under pressure using a microfilter (manufactured by Fuji Photo Film Co., Ltd.) with a pore size of 2.5 μm to prepare a pigment ink with a pigment concentration of 2 weight % and a dispersant concentration of 2 weight %.

| | |
|---|---|
| above described cyan dispersion | 4 parts |
| glycerin | 10 parts |
| diethylene glycol | 10 parts |
| acetylene glycol EO adduct (manufactured by Kawaken Fine Chemicals Co., Ltd.) | 0.5 parts |
| ion-exchanged water | 69.5 parts |

(2-6) Black Ink (Black Ink for Mat Paper)

Dispersion Preparation 10 g of carbon black with a surface area of 230 $m^2/g$ and a DBP oil absorption of 70 ml/100 g and 3.41 g of p-amino-n-benzoic acid are mixed well with 72 g of water, and after the addition of 1.62 g of nitric acid, the resultant was stirred at 70° C. A solution dissolving 1.07 g of sodium nitrite in 5 g of water was further added to this a few minutes later and the resultant was stirred for another 1 hour. Obtained slurry was filtrated with a filter paper (product name: Toyo Roshi No. 2; manufactured by Toyo Roshi Kaisha, Ltd.), and pigment particles obtained by filtration were sufficiently washed with water, and dried in an oven at 90° C., furthermore, water was added to this pigment to prepare pigment solution of 10 weight % pigment concentration.

Ink Preparation

Black ink was prepared by mixing components described below and after sufficient stirring and dissolution/dispersion, the resultant was filtered under pressure using a microfilter (manufactured by Fuji Photo Film Co., Ltd.) with a pore size of 3.0 μm.

| | |
|---|---|
| Obtained pigment dispersion as described above | 30 parts |
| Potassium sulfate | 1 part |
| Trimethylolpropane | 6 parts |
| glycerin | 6 parts |
| diethylene glycol | 6 parts |
| acetylene glycol ethylene oxide adduct (product name: Acetylenol EH (manufactured by Kawaken Fine Chemicals Co., Ltd.)) | 0.2 parts |
| water | 50.8 parts |

(3) Configuration Example of Control System

Figure 6:
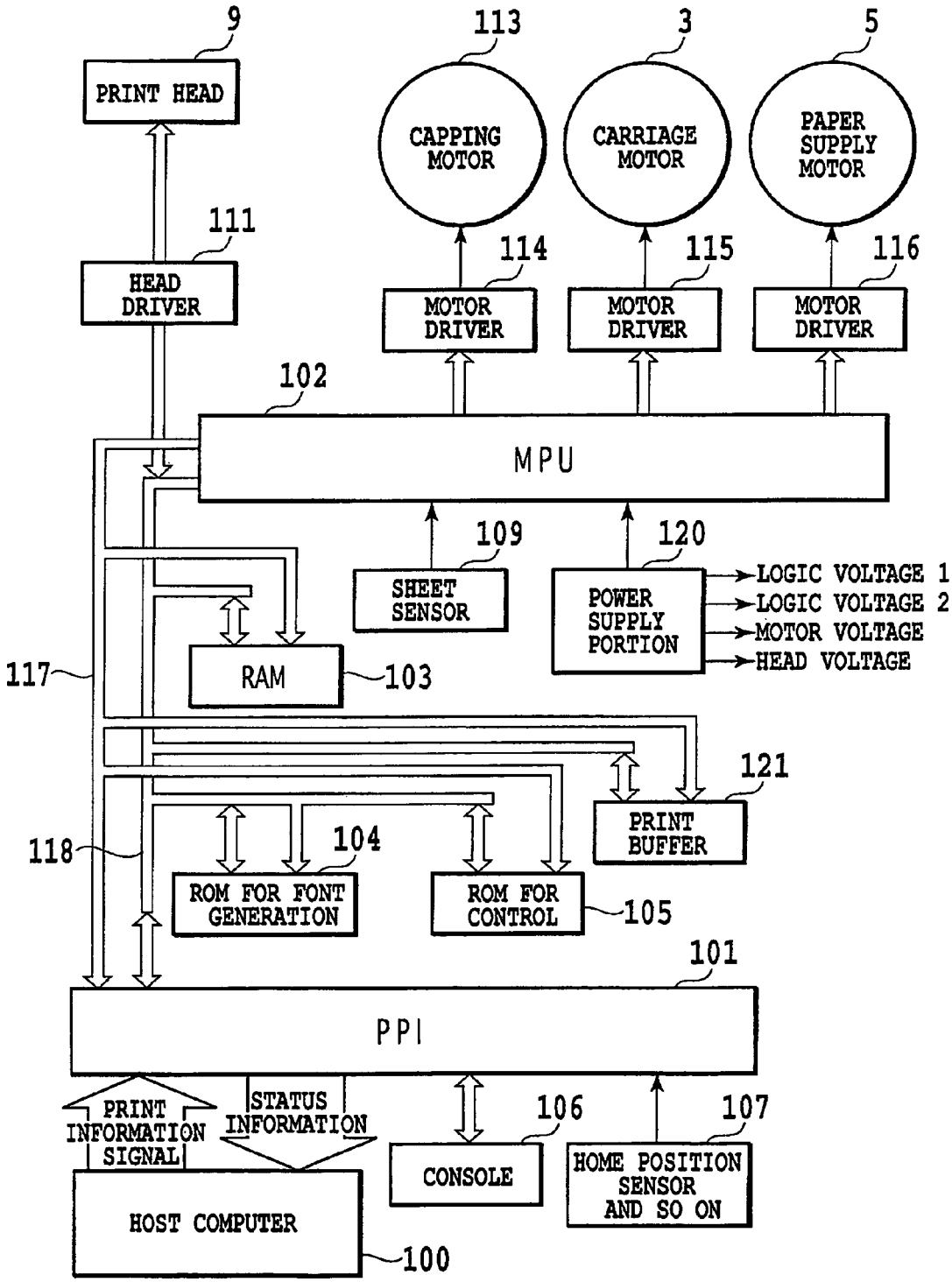
FIG. 6 is a block diagram showing an example of a configuration of a control circuit of the printer used in the embodiment of the present invention.

FIG. 6 shows a configuration example of control circuit in the printer used in the present embodiment. In FIG. 6, denoted 101 is a programmable peripheral interface (hereinafter referred to as PPI). The PPI 101 receives command signals (commands) sent from a host computer 100 and print information signals including print data, transfers them to an MPU 102, and also sends out status information on the printer where necessary to the host computer 100. Moreover, the PPI 101 performs input/output to/from a console 106 having a setting input portion, where users set various settings for the printer and a display portion displaying messages for users. Furthermore, the PPI 101 accepts output signals from sensor groups 107 including a home position sensor detecting that a carriage unit 102 or the print head 9 is present in the home position, a capping sensor, and so on.

The MPU (microprocessing unit) 102 controls each portion inside the printer according to a control programme stored in a ROM for control 105 and corresponding to a process procedure described later (FIGS. 7 to 10). Denoted 103 is a RAM to store received signals or being used as a work area for the MPU 102 and for storing various data temporarily. Denoted 104 is a ROM for font generation and is storing pattern information on letters and prints and so on corresponding to code information and outputs various pattern information corresponding to the inputted code information. Denoted 121 is a print buffer for storing print data expanded in the RAM 103 and so on and has a capacity capable of printing M lines. Apart from the above described control programme, fixed data corresponding to the data used during the control process described later (for example data for determining whether wiping execution related to a principal part of the present embodiment is required or not) can be stored in the control ROM 105. Each of these portions is controlled by the MPU 102 via an address bus 117 and a data bus 118.

Denoted 113 is a capping motor as a driving source for ascent/descent of the cap 27, movement of the wiper holder 25, and action of the pump 29. Reference numerals 114, 115, and 116 denote motor drivers for driving a capping motor 113, a carriage motor 3, and a paper supply motor 5, in accordance with the control by the MPU 102, respectively.

Denoted 109 is a sheet sensor and sense and detect the presence of print medium, that is, whether the print medium is supplied to a position capable of being printed by the print head or not. Reference numeral 111 denotes a driver for driving the heat generating portion 52 of the print head 9 in response to print information signals. Denoted 124 is a power supply portion for supplying power to each of the above described portions and having an AC adaptor and a battery as a drive source device.

In the printing system formed of the above described printer and the host computer 100 for supplying print information signals to the printer, print data is transmitted from the host computer 100 via a parallel port, an infrared port, or a network and so on. A required command is added to the forefront part of the print data. Examples include those described below as the command. That is,

- type of print medium used for printing (types of plain paper, OHP sheet, glossy paper and so on and furthermore, types of specific print media such as transfer film, carton, and banner paper),
- medium size (A0 size (841×1189 mm), A1 size (594×841 mm), A2 size (420×594 mm), B0 size (1030×1456 mm), B1 size (728×1030 mm), B2 size (515×728 mm) and so on),
- printing quality (draft, high quality, middle quality, emphasis on specific colour, and types of monochrome/colour)
- paper supply path (determined in accordance with forms and types of feeding means of the print medium equipped with the printer. For example, ASF, manual, paper feed cassette 1, paper feed cassette 2, and so on), and
- presence/absence of automated discrimination of object, and so on. Moreover, when the configuration which can apply processing liquid in order to improve ink fixability on the print medium is adopted, information for determining whether the application is to be performed and so on can be transmitted as a command.

Following these commands, the printer reads necessary data for printing from the aforementioned ROM 105 and carries out printing based on those data. As data, there are those for determining print pass number at the time of carrying out multipass print as described above and ink application amount per unit area of the print medium and print direction and so on. Moreover, there are also others determining the types of masks for thinning out data applied at the time of carrying out multipass print and drive conditions (for example, shapes of drive pulse applied to the heat generating portion 52 and applying time) of the print head, dot size, conveying conditions of the print medium and furthermore, also a carriage rate and so on.

(4) Control Procedure

FIGS. 7 to 10 show examples of a printer control procedure carried out using the above described configuration.

(4-1) Recovery Process Sequence

Figure 7:
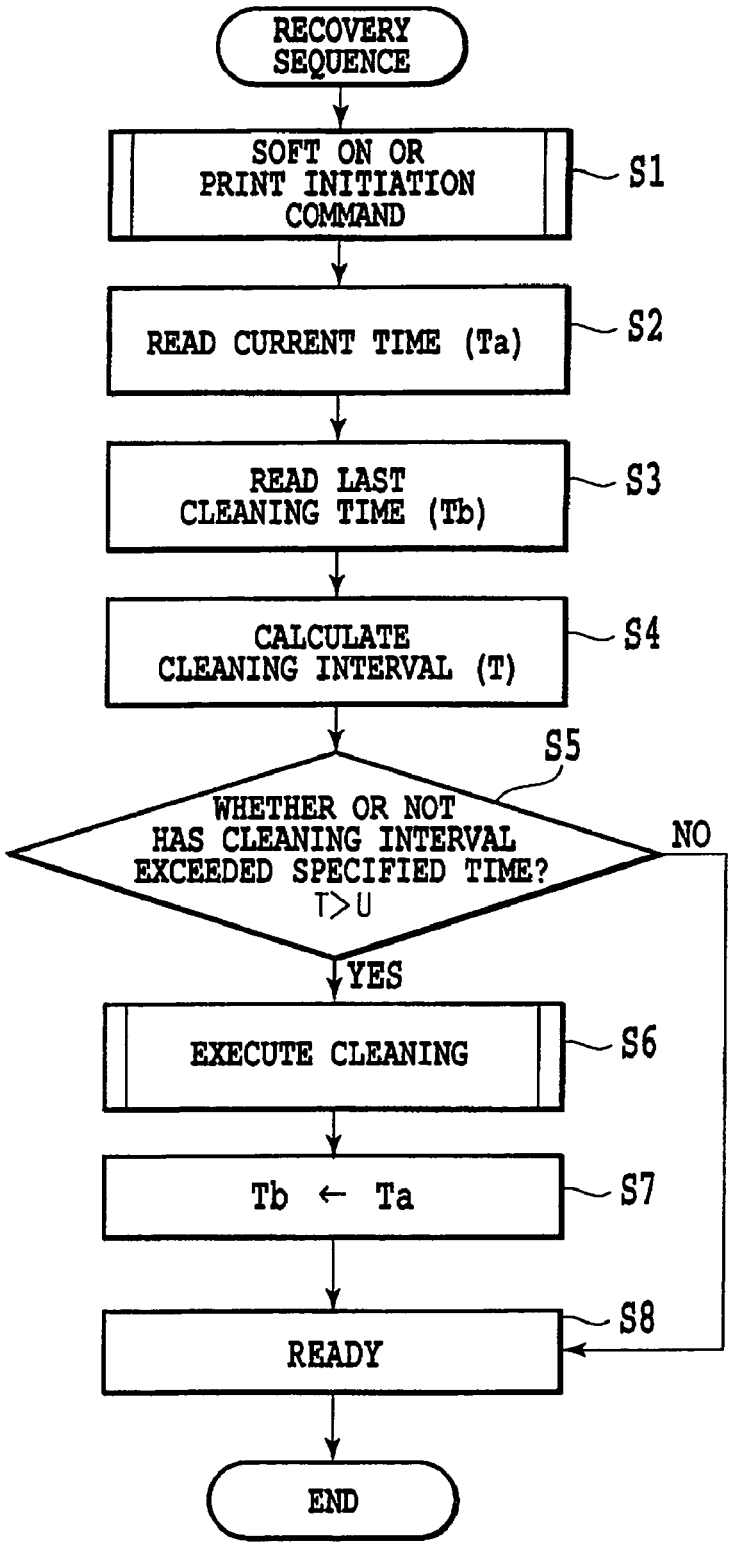
FIG. 7 is a flowchart showing an example of a recovery process sequence according to the embodiment of the present invention.

FIG. 7 shows a recovery (cleaning of the print head) process sequence. This sequence is activated in response to secondary power source input (soft on) putting the function as a printer after the primary power source input into a state actually executable, or an input of print initiation command from the host computer 100. Firstly, in step S2, the current time Ta is read and the time Tb when the recovery process was performed last time in step S3 is read. In step S4, calculation of elapsed time (cleaning interval T) is carried out. Subsequently, it is determined whether the calculated cleaning interval T exceeds the specific threshold value U or not in step S5, and when it was affirmed, cleaning, in other words, preliminary ejection and wiping operation are carried out in step S6. The content of the time Tb is then substituted by the time Ta in step S7 and the state comes to the READY state (step S8).

Incidentally, cleaning interval T can be calculated by knowing the current time Ta by a calendar function provided by the MPU102 or other appropriate means and by reading the value of Tb stored in a register region of the RAM 103 and so on. Moreover, using a timer like programmable interval timer (PIT), cleaning interval T can be known where appropriate by resetting/restarting the timer for each cleaning execution.

(4-2) Print Process Sequence

Figure 8:
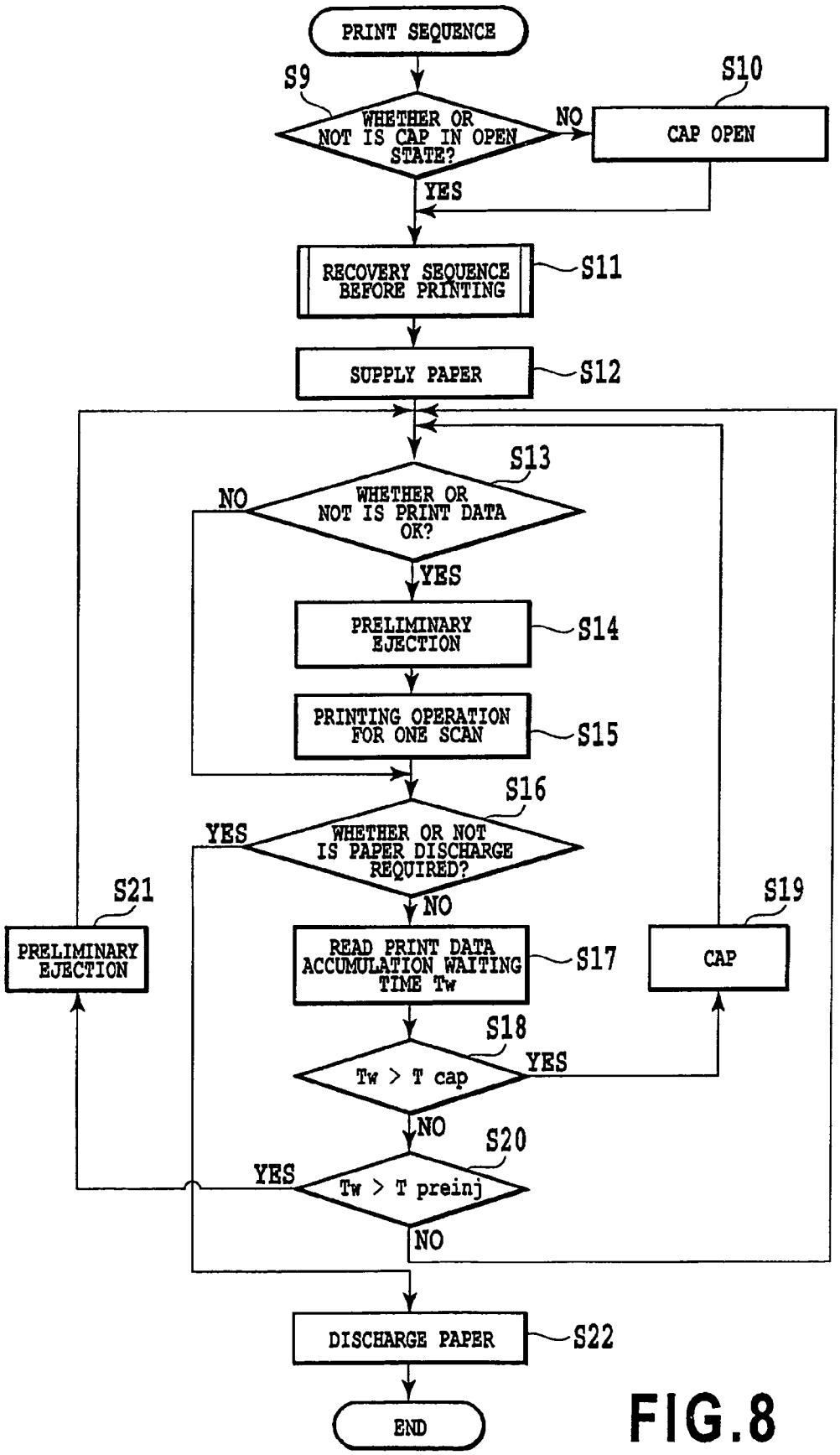
FIG. 8 is a flowchart showing an example of a printing process sequence according to the embodiment of the present invention.

FIG. 8 shows the print process sequence. When the printer is in a dormant state, as described above, since capping is applied to the print head 9 or the ejection face of the ejecting portion, the cap is released and the print head or the carriage unit 2 is put into a state where scanning is possible. In other words, the determination is made in step S9 based on a sensor, which may be provided as a component of the above sensor groups 107, for detecting whether it is in a capped state or not for example. When it was in the capped state, the cap 27 is lowered down to put into a cap open state (step S10).

Subsequently, the recovery sequence as described in FIG. 7 is appropriately executed in step S11 prior to the printing and then the print medium is fed (step S12) and conveyed to the print initiating position. Moreover, whether data is accumulated in an amount of one scanning or not in a print buffer 121 is determined (step S13) When it was affirmed, preliminary ejection is executed to the cap 27 descending while opposing the ejection face in step S14. The carriage unit 2 is then made into scan by the carriage motor 3 and the printing operation of the accumulated data is executed in step S15. Furthermore, it is determined whether or not to discharge the print medium (paper discharge) accompanied with the completion of print process for print data whose amount equals to that of one page of the print medium and a paper discharge command and so on, and when it was affirmed, the paper discharge is carried out in step S22 and the present procedure is completed.

After printing operation of the amount of one scanning is completed, or when it was determined that data accumulation is incomplete in step S13, after going through step S16, print data accumulation waiting time Tw for the scan is read in step S17. This waiting time can be known by, for example, using a similar timer to that described above and measuring elapsed time from the point where the determination was denied first in step S13 in each scan. Subsequently, whether the waiting time Tw exceeded a predetermined time Tcap or not is determined in step S18 and when it was denied, whether the waiting time Tw exceeded a predetermined time Tpreinj or not is determined in step S20. When the latter determination was also denied, the procedure returns to step S13. After printing operation for one scan is completed, this determination in step S13 will be the one for the next scan.

When it was determined that the waiting time Tw exceeded the predetermined time Tcap in step S18, after capping was applied in step S19, the procedure returns to step S13 and further awaits for the data to accumulate. It should be noted that, it is possible to interpose similar procedures to those of the above described steps S9 and S10 after the affirmative determination in step S13, by taking into consideration that there is a case where such capping is applied.

Moreover, when it was determined that the waiting time Tw exceeded the predetermined time Tpreinj in step S20, after executing preliminary ejection in step S21, the procedure returns to step S13 and further awaits for the data to accumulate. Incidentally, the relationship between the predetermined time Tpreinj and the above described predetermined time Tcap can be the one described as Tpreinj<Tcap.

It should be noted that although preliminary ejection is carried out every time immediately before the initiation of each scan in the procedure described so far, it is possible to manage the elapsed time since the last preliminary ejection by using a timer as described above and determine whether the execution of the preliminary ejection is required or not.

Moreover, in the preliminary ejection and so on carried out during the time between the releasing of the cap and the initiation of the printing, it is also possible to carry out the ejection of uniform numbers for all the ejection openings or to carry out the ejection of numbers determined by the elapsed time and so on. In addition, it is also possible to set preliminary ejection conditions such as the numbers and execution timing for each colour ejecting portion. Furthermore, especially for the preliminary ejection carried out during the printing, it can be carried out for only nozzles not used until the time of last scan or for all the nozzles including those that are used. In addition, the number of ejection can be reduced for the used nozzles based on the used frequency. Besides, the preliminary ejection is not limited to that carried out by moving and setting the print head to a position opposite to the cap 27 as described above. Additionally, it is also possible to include that to improve the print speed by carrying out the preliminary ejection to an appropriate area on the print medium where the print image quality is not reduced while performing the printing operation.

(4-3) Sequence after the Completion of the Printing

Figure 9:
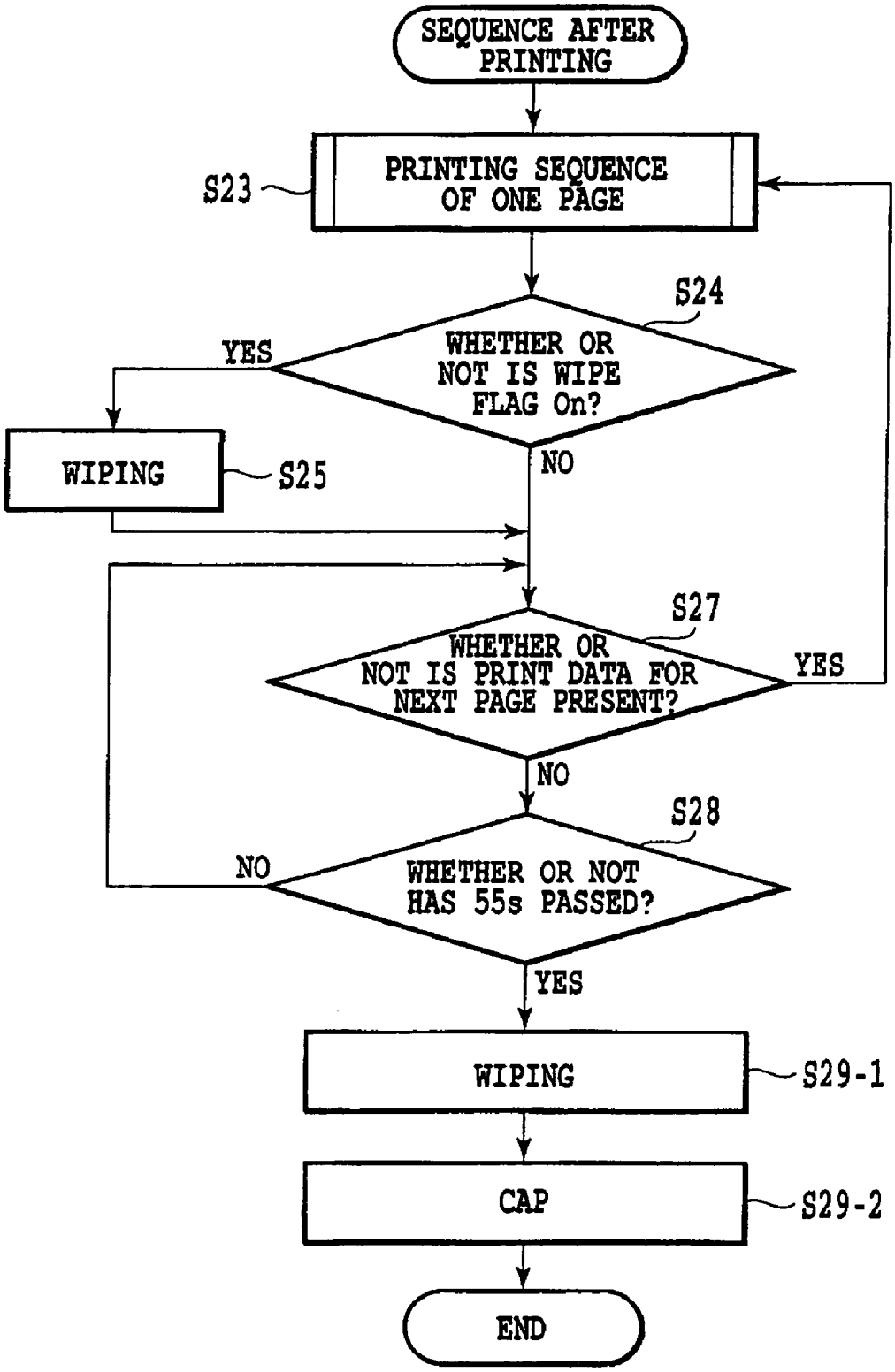
FIG. 9 is a flowchart showing an example of a sequence after the printing process according to the embodiment of the present invention.

FIG. 9 shows a sequence executed after completing the printing. When printing sequence (step S23) in an amount of one page of the print medium is completed, the content of the wipe flag (described later) specifying whether to carry out wiping in step 24 is determined and when it was on (set state) wiping is carried out (step S25). Moreover, resetting of the wipe flag and the dot counter is carried out at this stage.

Whether the print data in a next page is present or not is determined in step S27 and when it was affirmed, the procedure returns to step S23 to execute printing sequence of the print data in the next page. On the other hand, when it was denied, the procedure waits (step S28) for a predetermined time (for example 55 seconds). When the print data in the next page is not present inspite of the waiting, wiping is carried out (step S29-1) and the present procedure is completed after applying capping (step S29-2).

Incidentally, whether the wiping is to be executed or not was determined every time the printing sequence for each page was completed in the present procedure. This is effective to prevent the occurrence of color irregularity due to a difference in time between scans in one page of the print medium caused by the insertion of the wiping operation. However, it is also possible to make determinations for each scan or once for each plurality of scans appropriately in cases where a plotter has a large print area and a printer carrying out the printing using printing media with relatively large sizes such as A0 size and A1 size is used.

A wipe flag can be provided in a part of a region of the RAM 103 in the present embodiment. The wipe flag basically can be set according to the number of ejection from the ejecting portions, that is, count value of print dots. The count value of the print dots can be obtained, for example, by carrying out the dot count at the time of accumulating print data for each colour in the amount of one scanning in a buffer, or during or after the printing of the amount of one scanning and then adding the count value to a count area provided in a predetermined region of the RAM 103 for instance.

However, as described earlier, since the differences in the amount of mist generated and the adhered amount occur in response to the ink property, preferable timing of wiping cannot be determined by simply basing on the dot count value. Accordingly, in the present embodiment, the amount of mist generated for each ink or ejecting portion is included in the dot count operation.

(4-4) Wipe Flag Setting Sequence

Figure 10:
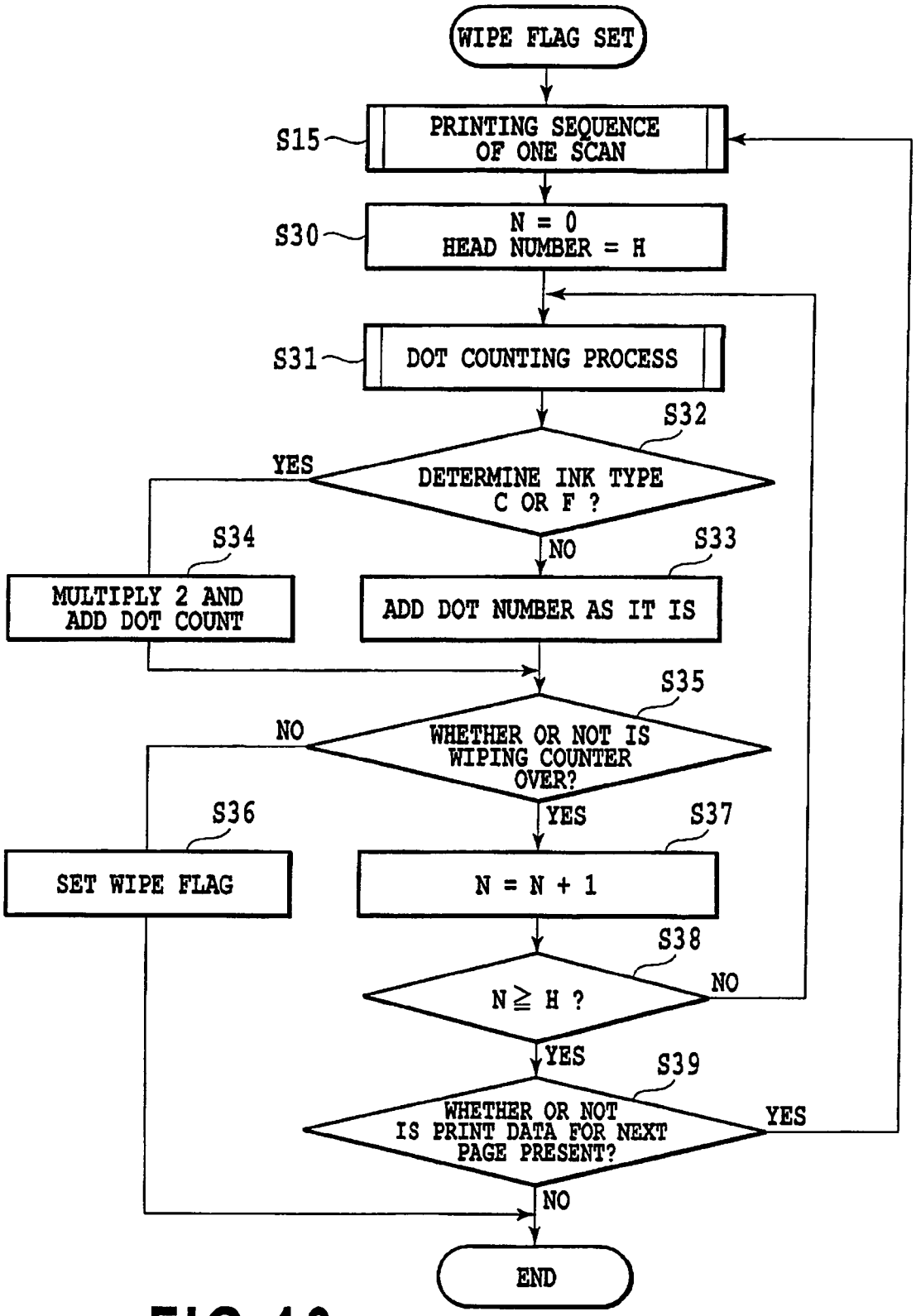
FIG. 10 is a flowchart showing an example of a setting process sequence of the wipe flag according to the embodiment of the present invention.

FIG. 10 shows a wipe flag setting sequence of the present embodiment. This procedure is carried out every time when the printing of the amount of one scanning is completed. Moreover, in the procedure below, 6 types of inks A to F are used and these corresponds to each of the colour ink described above, in other words, black, light cyan, cyan, light magenta, magenta, and yellow inks. Bsase on the ink composition, it is assumed that the amount of mist generated is especially large in ink C (cyan ink) and ink F (yellow ink) being approximately as twice as that of other inks.

When the printing (step S15) for one scan is completed, a number of ejecting portion H ("6" in the present example) is set in step S30 firstly and reset a parameter N for determining ejecting portion to perform dot counting to "0". Subsequently, the dot counting for the ejecting portion determined by the parameter N or colour ink is carried out in step S31. It is then determined in step S32 whether ink for which the dot counting was performed is ink C or ink F and correction of the dot count value is carried out. When an ink other than ink C or ink F was used here, the dot count value is added as it is in step S33 whereas when it was either ink C or ink F, weight assignment is performed (step S34). In other words, the dot count value is doubled and added in the case of the present embodiment.

Subsequently, in step S35, it is determined whether accumulated value of the dot count exceeded a predetermined value and when it is denied, the parameter N is incremented by +1. When the dot count for all colours or all ejecting portions of one scan is not completed (a case of determination denial in step S38), the procedure returns to step S31 and performs the dot counting process for the next ink colour. When the dot count for all colours or all ejecting portions of one scan is completed (a case of determination affirmation in step S38), it is determined whether the print data for the next scan is present or not and when it was affirmed, the procedure returns to step S15 and when denied, complete the present procedure.

On the other hand, when it was determined that the accumulated value of the dot counting exceeded the predetermined value in step S35, a wipe flag is set in step S36. In this case, since wiping should be executed necessarily after the completion of the printing, without waiting for the dot count result after the next colour or the next scan, the present procedure is completed.

It should be noted that although a dot counter collectively managing the dot count value of all colours is used in the sequence described so far, the dot counter can be provided for each colour or for every several colours. Alternatively, it is also possible to provide a dot counter managing the dot count value of ink which is likely to generate mist and a dot counter collectively managing the dot count values of other inks.

(4-5) Setting of the Wiping Conditions

In the procedure in FIG. 10, the reason for setting weighting coefficient for the dot count value two-fold is that it was assumed that the amount of ink mist generated in cases using ink C and ink F is approximately twice as that of other inks. In practice, this coefficient should be set in accordance with the condition of mist generation of each ink. Moreover, the amount of ink mist generated differs not only due to the properties of ink itself but also owing to a configuration of the ejecting portions using this ink and also the ejection recovering degree of the ejecting portion by the recovery operation.

FIG. 11 shows the amount of mist in a case where a plural kinds of inks are ejected using two print heads with different heater size and nozzle size in the ejecting portions, and a result determining ejection recovery in a case where qualities of ejection state are determined following normal recovery operation after leaving the print head under predetermined conditions. Here, the heater and the nozzle are corresponding to the heat generating portion 52 and the nozzle 55 in FIG. 3, respectively. The above described inks A to F are used as the plural kinds of inks. Moreover, the print head standing conditions are as follows. The print head is left to stand for 3 days in an environment with a temperature of 30° C. and a humidity of 10% in a state where ink is filled therein and the print head is mounted on the printer main body.

As shown in this figure, in a case where a print head H1 (that with a relatively small heater size and a relatively small nozzle cross sectional area) was used, as far as mist amount is concerned, although the amounts were somewhat high in ink C and ink F, favourable results were generally obtained. However, ejection recovering degrees were poor as to ink A, ink C, and ink F and therefore, the print head was in a state where it could not be used as it was. On the other hand, in a case where a print head H2 (that with a relatively large heater size and a nozzle cross sectional area, which is approximately as large as that of the one normally used) was used, although ejection recovering degrees are good, mist amount is higher in general.

From this result, although designing each ejecting portion in accordance with properties of ink used to reduce the mist amount can be considered, designing of optimal ejecting portions individually to make the print head leads to an increase in cost. Moreover, in the configuration shown in FIG. 2, although it is possible to mount an optimal ejecting portion since a plurality of ejecting portions are mounted in one print head, when considering the manufacturing steps and facilities, or a case where an ink with different characteristics is used, it is not a realistic response.

On the other hand, according to the configuration of the present embodiment, the wiping conditions can be set by determining weighting coefficient adequately not only for a case where there is an ink set including the one with a large mist amount, but also for a case where the configuration of the print head or the ejecting portion also participate in the amount of mist generated.

FIG. 12 shows wiping ability after printing was carried out while changing printing duties of each ink A to F. It should be noted that the wiping conditions used at the time of the printing was a conventional ones and although printing duty at the time of dot addition are considered, mist amount and bahaviour when evaporating due to the difference in ink are not considered. For all cases of "No. 1" to "No. 4" a pattern adjusted so that the total duties become 150% was printed on 120 pieces of A0 sized printing medium. Thereafter, a check pattern for each colour while changing the printing duty from 20% to 100% in 20% increments was printed and by confirming the occurrence of defective ejection or ejection failure due to wet ejection face the wiping abilities were evaluated.

In "No. 1" and "No. 3", the printing duty of ink F is set higher than those of other inks and defective ejection or ejection failure was observed in the check pattern with a low printing duty (20~40%). In "No. 2", while the printing duty of ink F is reduced to a degree equivalent to that of other inks, a pattern with the printing duty of ink A set high instead was printed. In this case, the defective ejection or ejection failure due to wetting was observed only in the check pattern with a high printing duty (80~100%). Furthermore, in "No. 4", the printing duty of ink F was set to 0% and the defective ejection or ejection failure was not observed.

As described so far, the amount of ink mist adhering to the ejection face can vary due to the printing duty. Therefore, it is possible to adopt a configuration where increase and decrease in the dot count value is performed by applying coefficient calculated based on the printing duty for the dot count value.

FIG. 13 shows printing evaluation results as well as print head durability evaluation results in a case where wiping conditions are set based on the present embodiment and in comparative examples where various wiping conditions are set. Print is made for various images. For the print patterns, although there are small variations in used ratio of each colour, generally ink A is approximately 18%, ink B is approximately 20%, ink C is approximately 5%, ink D is approximately 30%, ink E is approximately 8%, and ink F is approximately 17%.

A "wiping condition i" is the one applying a sequence of the present embodiment. It was set so that wiping was executed with approximately 37 sheets of an A0 sized print medium when printed using ink F at a printing duty of 17% and for other inks, it was set so that wiping was executed with approximately 70 sheets of A0 sized print media at a printing duty of 20%.

A "wiping condition ii" is a conventional one and its print duty are considered at the time of dot addition but the mist amount and so on due to the differences in ink are not considered. A "wiping condition iii" is set in accordance with ink F which generates mist in large amount. A "wiping condition iv" is one where the wiping condition is set by further taking account the print duty into the "wiping condition ii" while not considering ink types. In the "wiping condition iii" and the "wiping condition iv", frequent wiping is performed.

As shown in FIG. 13, when the present embodiment is applied, wiping is performed with a frequency optimized for ink F when the print duty of ink F are high. On the other hand, wiping optimized for other inks is performed when the print duty of ink F are low. Accordingly, favourable printing results can be obtained while preventing the roughening of ejection face due to the frequent wiping performance and to realizing an improvement in head longevity.

On the other hand, debasement in print image qualities originated from defective ejection or ejection failure due to wetting was observed in the "wiping condition ii" although there was no problem in head durability. Moreover, wiping is performed uniformly with a high frequency set for ink F in the "wiping condition iii" and the "wiping condition iv". Hence it was verified that the ejection face quickly did become rough and before the life of the print head itself ended due to the deterioration in heat generating portion, life thereof substantially ended.

(5) Second Embodiment

There is a case where ink components on the head surface is already evaporated at the time of wiping performance and in a state where it is difficult to wipe away by wiping alone. Such examples include a case where ink contains volatile solvents with low boiling point such as ethanol and IPA, a case where ink contains a large amount of polymer for pigment dispersion, and a case where aggregates are likely to occur due to low dispersion of ink pigment.

In such inks, initial viscosity is not much different from that of other inks and there are few cases having problems in wiping abilities at the time of wiping. However, viscosity is more likely to be enhanced than those of other inks when evaporating.

Figure 14:
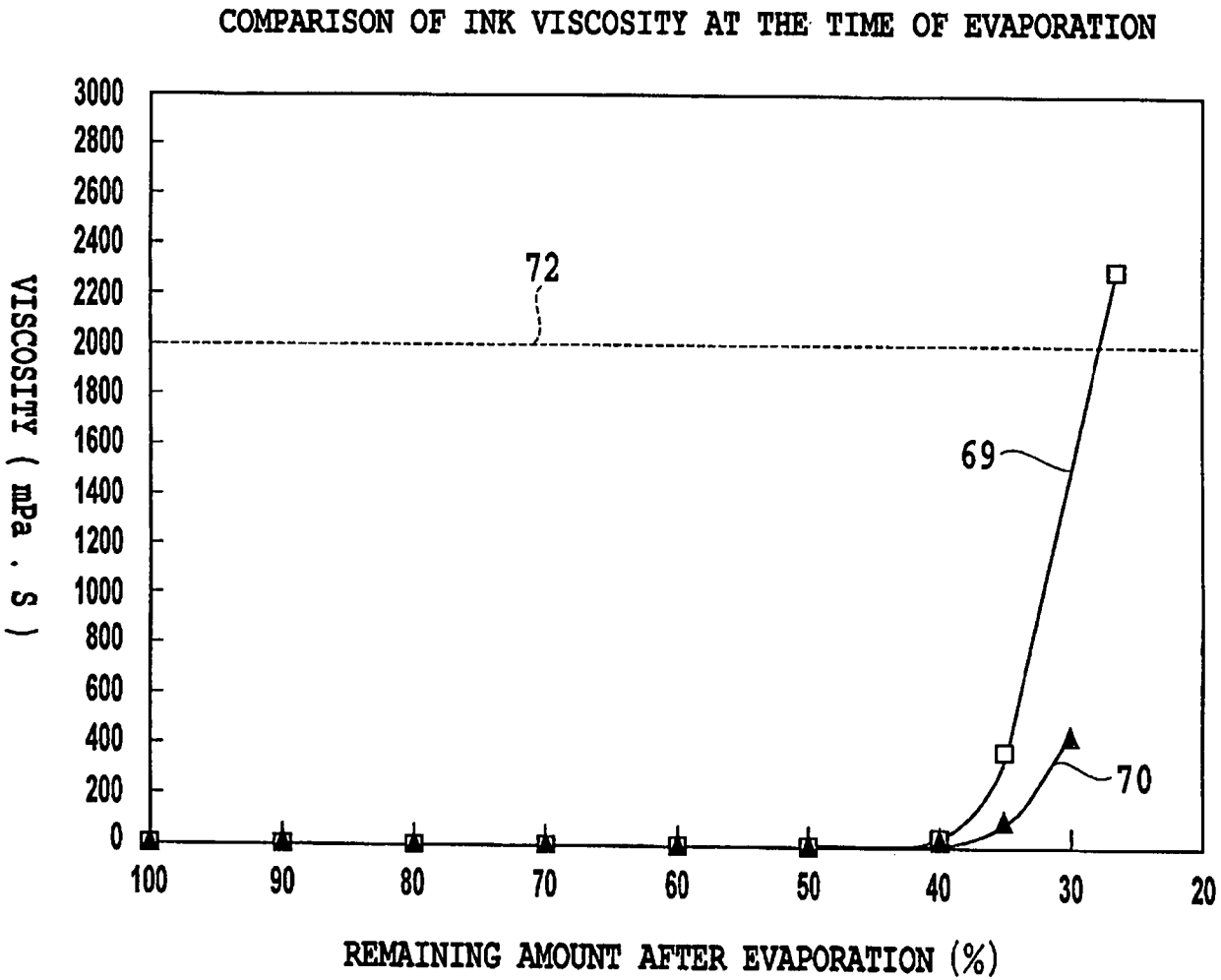
FIG. 14 is an explanatory diagram for explaining viscosity behavior when ink is evaporating.
Figure 15:
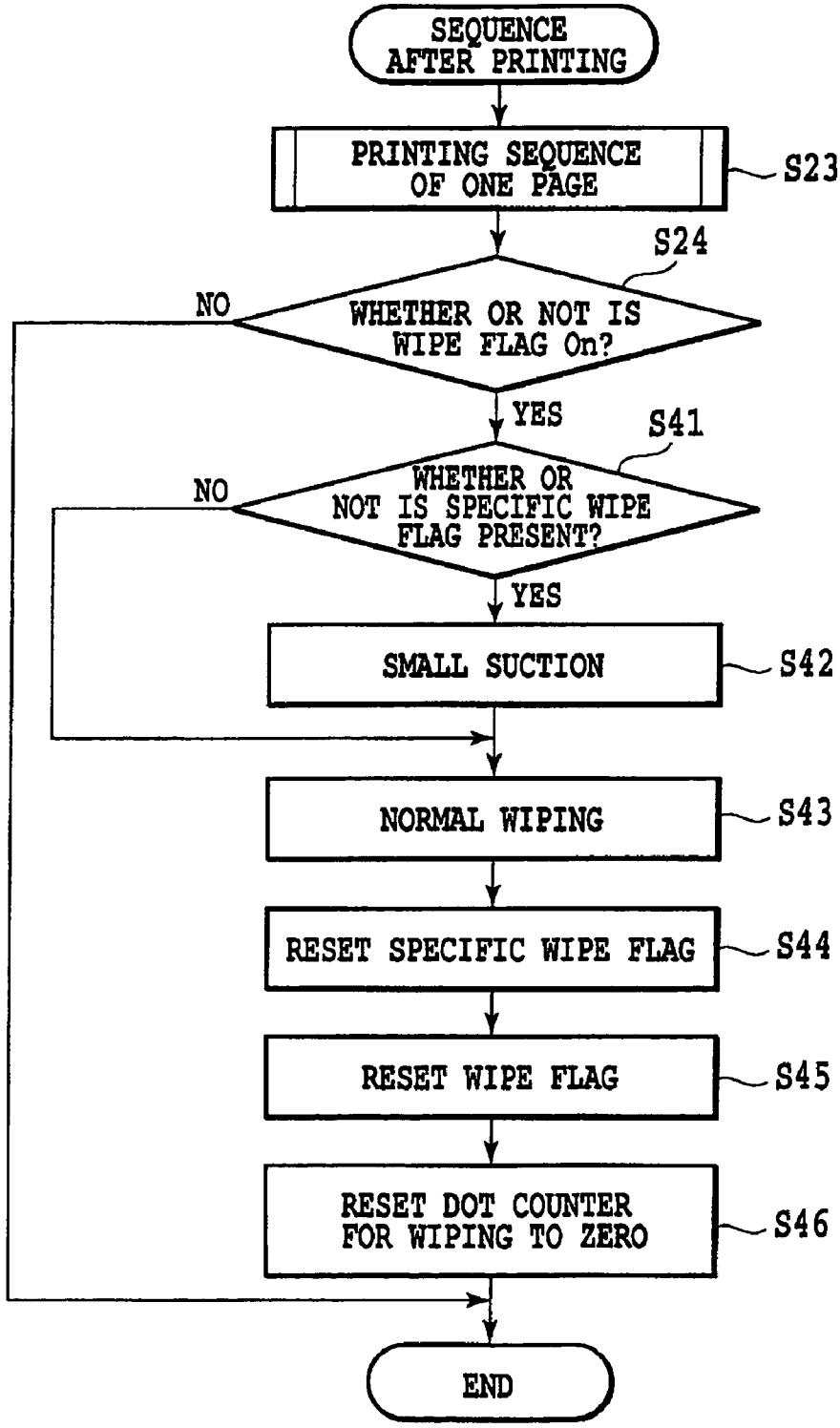
FIG. 15 is a flowchart showing an example of a recovery process sequence according to another embodiment of the present invention.

FIG. 14 shows viscosity behaviour when such ink evaporating. Although there is not much difference between a viscosity curve 69 of ink F and a viscosity curve 70 of ink A until the evaporation where the remaining amount is approximately 50%, the viscosity curve 69 of ink F dramatically starts to rise approximately when the remaining amount fall below 50%, and there is a large difference between the two curves when the remaining amount is approximately 30% (70% evaporated). Since the viscosity curve 69 of ink F in particular exceeds 2000 mPa·s as a limit 72 of wiping ability, the wiping is extremely difficult and ejection recovering degree is reduced (refer to FIG. 11).

In the present embodiment, when an ink is used whose viscosity exceeds 2000 mPa·s when evaporation amount in an environment with a temperature of 30° C. and a humidity of 10% reaches an equilibrium, the dot count value of the ink is adequately corrected and appropriate wiping condition is set. Favourable ejection recovering degrees are achieved by this.

Moreover, in the present embodiment, wipe flag setting sequence like that described in the first embodiment above is used and also enhance an effect of ejection face cleaning (ejection recovering degree) for an ink whose viscosity increases markedly after evaporation (ink F, for example). For this purpose, cleaning by suction operation is performed before wiping.

FIG. 14 shows a procedure of sequence after printing adopted in the present embodiment and characterized as a process interpose immediately after step S24 in FIG. 9. That is, when the printing sequence (step S23) for an amount of one page of print medium is completed as shown in FIG. 8, wipe flag content to specify whether or not to perform wiping is determined in step S24. The present procedure is completed when in off state (reset state) and transit to step S27 in FIG. 9. On the contrary, when in on state (set state), the processes after step S41 are carried out.

In step S41, the content of special wipe flag is confirmed. Here, special wipe flag can be the one, which is set when the dot count value of ink whose viscosity increases markedly after evaporation (ink F) reaches or exceeds a predetermined value. In this case, a dot counter dedicated for the management of the dot count value of the ink in the sequence in FIG. 10 can be provided. Moreover, weighting coefficient multiplied can also be appropriately set.

When it was determined that the special wipe flag is on in step S41, capping is applied to the print head 9 and a suction operation (small suction) is executed by driving the pump 29. This is an operation carrying out suction of, for example, approximately 0.3 cc for each colour ink by considering the reduction in the amount of ink consumption.

Subsequently, or when it was determined that the special wipe flag is off in step S41, normal wiping is carried out in step S43. The special wipe flag and the wipe flag are then reset in steps S44 and S45, respectively and further performing a reset of the dot counter and transit to step S27 in FIG. 9.

In the case of the present embodiment, suction process is carried out when the dot count value of a predetermined type of ink with a large amount of mist generation (ink F) reaches or exceeds the predetermined value. As a result, the ejection face is humidified to decrease the viscousity of the ink and even when the evaporation of the predetermined type of ink is proceeded to some extent, performing of wiping in favourable conditions is possible.

Incidentally, it is generally considered that recovering degree is better when suction amount is large and there is a tendency that recovering performance will be better in terms of defective ejection or ejection failure, which the present embodiment is trying to solve and is originated from wetting. Therefore, when the special wiping is not carried out so often, especially when the rigid adhesion of mist is concerned, it is also possible to further increase the suction amount.

Moreover, in order to humidify the ejection face prior to wiping, apart from carrying out suction, it is possible to perform a preliminary ejection or to apply processing solution to the ejection face in order to improve wiping ability.

Furthermore, it is also possible to manage the correction of the dot count value corresponding to the ink generating a large amount of mist and the correction of the dot count value corresponding to the ink whose viscosity increases markedly after evaporation, separately. In this case, even after the determination was denied in step S24 for example, in other words, even when the dot count value corresponding to the ink generating a large amount of mist has not reached the predetermined value, the processes of steps S42 and S43 can be carried out when the special wipe flag is on. According to this, the reduction in wiping abilities due to the fixed adhesion of the ink can be further prevented. Moreover, it is also effective for a case where the ink generating a large amount of mist and the ink whose viscosity increases markedly after evaporation do not correspond.

Moreover, in the present embodiment, although it was explained that the sequence based on the special wipe flag was placed in the wiping sequence adopted in the first embodiment, it is also possible to carry out independently from the first embodiment.

(6) Others

Incidentally, there are various methods for ink ejection applied to the above described printer. In other words, it is also possible to use those provided with an electrothermal transducer element producing thermal energy generating film boiling in ink in response to electrification as described above, or to use those provided with an electricity-mechanical energy converting element like piezo elements.

Moreover, in the configuration described above, although the case of using black, light cyan, cyan, light magenta, magenta, and yellow inks is explained, it is needless to say that the number of colour tones and types of ink used such as colour and density can be determined where appropriate. In addition, inks generating a large amount of mist were explained as ink C (cyan ink) and ink F (yellow ink) and an ink whose viscosity increases after evaporation was explained as ink F, and thus, the case where correction of dot counting was performed, was respectively explained. However, the extent of these ink conditions (the amount of mist generation and viscosity) are related to ink composition and it is needless to say that these are simply for examples shown.

Furthermore, numerical values described in the above mentioned embodiment are also only for examples shown and it is needless to say that the present invention is not limited to these.

Additionally, the case where the present invention was adopted for the printer of so called a serial type was explained in the above embodiments. However, the present invention is also effective for the printers using ink jet print head of so called a full line type formed by arranging nozzles in the range corresponding to the total width of the print medium.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application No. 2005-061273 filed Mar. 4, 2005, which is hereby incorporated by reference herein.

What is claimed is:

1. An ink jet printing apparatus carrying out printing using a plurality of groups of ejecting portions for ejecting different kinds of inks, respectively, comprising:

a wiping member for wiping a surface provided with ejection openings in each of the plurality of groups of ejecting portions for ejecting the respective inks;

wiping control means for controlling a timing for causing the wiping member to carry out the wiping based on kinds of inks which are used in the plurality of groups of ejecting portions; and means for counting a number of ejections carried out by the plurality of groups of ejecting portions in order to perform the printing, wherein the wiping control means corrects a value counted by the counting means in accordance with the ink kind and determines the timing in response to the corrected count value.

2. An ink jet printing apparatus as claimed in claim 1, wherein the wiping control means carries out the correction by multiplying a weighting coefficient in accordance with the ink kind with the count value counted by the counting means.

3. An ink jet printing apparatus as claimed in claim 1, wherein the inks ejected from the plurality of groups of ejecting portions differ in mist generating amount based on the kinds of inks.

4. An ink jet printing apparatus as claimed in claim 1, wherein the inks ejected from the plurality of groups of ejecting portions differ in viscosity based on the kinds of inks.

5. An ink jet printing apparatus as claimed in claim 1, further comprising means for discharging ink from the ejection openings prior to the wiping.

6. An ink jet printing apparatus as claimed in claim 1, wherein a configuration of the ejecting portion and/or a printing duty of the ink is considered in addition to the ink kind.

* * * * *